US009651908B2

(12) United States Patent
Nagashima

(10) Patent No.: US 9,651,908 B2
(45) Date of Patent: May 16, 2017

(54) IMAGE FORMING APPARATUS, METHOD FOR CONTROLLING AMOUNT OF LIGHT, AND METHOD FOR CONTROLLING IMAGE FORMING APPARATUS

(71) Applicant: CANON KABUSHIKI KAISHA, Tokyo (JP)

(72) Inventor: Satoru Nagashima, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/736,812

(22) Filed: Jun. 11, 2015

(65) Prior Publication Data

US 2015/0362878 A1 Dec. 17, 2015

(30) Foreign Application Priority Data

Jun. 13, 2014 (JP) ..... 2014-122445

(51) Int. Cl.
*G03G 15/00* (2006.01)

(52) U.S. Cl.
CPC ..... *G03G 15/5058* (2013.01); *G03G 15/5041* (2013.01); *G03G 15/5054* (2013.01)

(58) Field of Classification Search
CPC ..... G03G 15/5041; G03G 15/5054; G03G 15/5058
See application file for complete search history.

(56) References Cited

U.S. PATENT DOCUMENTS

2005/0030562 A1* 2/2005 Hama ..... G03G 15/5058 358/1.9
2008/0019721 A1* 1/2008 Okano ..... G03G 15/5041 399/52
2010/0080603 A1* 4/2010 Takahashi ..... G03G 15/50 399/72
2011/0255908 A1* 10/2011 Takezawa ..... G03G 15/0194 399/301
2012/0020680 A1* 1/2012 Zaima ..... H04N 1/6033 399/15
2013/0022377 A1* 1/2013 Sugeta ..... G03G 15/0189 399/301
2013/0302048 A1* 11/2013 Sekiguchi ..... G03G 15/0189 399/49
2013/0302049 A1* 11/2013 Nakagawa ..... G03G 15/5062 399/49
2013/0302050 A1* 11/2013 Shimba ..... G03G 15/0189 399/49
2013/0302051 A1* 11/2013 Shimba ..... G03G 15/5025 399/49

FOREIGN PATENT DOCUMENTS

JP 05-249787 A 9/1993
JP 2000-039746 A 2/2000
JP 2009-93155 A 4/2009

* cited by examiner

*Primary Examiner* — Ryan Walsh
(74) *Attorney, Agent, or Firm* — Canon USA, Inc. I.P. Division

(57) ABSTRACT

An image forming apparatus determines, based on detection performed by an optical sensor unit on an intermediate transfer belt while light-emitting devices emit a predetermined amount of light, an amount of light the light-emitting devices emit when the optical sensor unit detects a misregistration detection toner pattern and a density variation detection toner pattern.

17 Claims, 17 Drawing Sheets

TONER PATTERNS PLAN VIEW
TONER PATTERNS CROSS-SECTIONAL VIEW
MISREGISTRATION DETECTION TONER PATTERNS
DENSITY VARIATION DETECTION TONER PATTERNS
Y K Y
M C
C M
Y K Y
Y
M
C
K
219
1011
1012
1013
1014
1015
1016
1017
1018
1019
1020
1021
1022
1023
1024
1025
1026
1027
1028
1029
1030
1031
1032

ANALOG OUTPUT VOLTAGE (V)
Vth2
Vth1
COLOR PATCH MAXIMUM Vtmax
COLOR PATCH MINIMUM Vtmin
ON BELT SURFACE Vbmax
K PATCH MAXIMUM Vkmax
TONER PATTERN POSITION
1041
1042
1043
1044
1045
1046
1047
1048
1049
1050
1051
1052
1053
1054
1055
1056
1057
1058
1059
1060
1061
1062
1063
1064
1065
1066
1067
1068
1069
1070
1071
1072

MISREGISTRATION DETECTION TONER PATTERNS
DENSITY VARIATION DETECTION TONER PATTERNS
Y K Y
M
C
M
Y K Y
Y
M
C
K
219
1011
1012
1013
1014
1015
1016
1017
1018
1019
1020
1021
1022
1023
1024
1025
1026
1027
1028
1029
1030
1031
1032
TONER PATTERNS PLAN VIEW
TONER PATTERNS CROSS-SECTIONAL VIEW

COLOR PATCH MAXIMUM Vtmax
COLOR PATCH MINIMUM Vtmin
ON BELT SURFACE Vbmax
K PATCH MAXIMUM Vkmax
α
β
TONER PATTERN POSITION
1343
1344
1365
1364
Vth2
Vth1
ANALOG OUTPUT VOLTAGE (V)

IMAGE FORMING APPARATUS, METHOD FOR CONTROLLING AMOUNT OF LIGHT, AND METHOD FOR CONTROLLING IMAGE FORMING APPARATUS

BACKGROUND

Field

Aspects of the present invention mainly relate to an image forming apparatus, such as a copying machine or a printer adopting an electrophotographic method or an electrostatic storage method, a method for controlling the amount of light, and a method for controlling the image forming apparatus, and particularly relates to a method for detecting the amount of misregistration and the amount of variation in density of each color developer formed on an image bearing member or an intermediate transfer member.

Description of the Related Art

Color image forming apparatuses including a plurality of photosensitive drums are currently designed to suppress misregistration of an image of each color, but due to a mechanical installation error of each photosensitive drum, an optical path length error of a laser beam of each color, a change in each optical path, and the like, misregistration occurs between the images. For this reason, a method for correcting the misregistration between the images is needed. In addition, because the density of each image varies due to conditions such as a use environment and the number of sheets printed, and accordingly color balance (so-called "tone") varies, a method for correcting the density of each image is needed. As a method for correcting the amount of misregistration and the amount of variation in density of each image, for example, the following method is disclosed in Japanese Patent Laid-Open No. 05-249787. That is, a method is disclosed in which toner patterns are formed on an image bearing member and an optical sensor including light-emitting devices and light-receiving devices detects the formed toner patterns. The amount of misregistration and the amount of variation in density of each image are then calculated and corrected.

In addition, for example, in Japanese Patent Laid-Open No. 2000-039746, a method for controlling the amount of light emitted by light-emitting devices of an optical sensor is disclosed. When detecting toner patterns, the optical sensor receives diffuse reflection light and specular reflection light. The amount of light received by the optical sensor and an output voltage of the optical sensor that has performed photoelectric conversion on the received light vary depending on various factors. The optical sensor therefore detects the toner patterns transferred onto an image bearing member or an intermediate transfer member, and the amount of light, which is emitted by the optical sensor, necessary to obtain a desired amount of light received is calculated based on the amount of light received and the amount of light emitted by the light-emitting devices obtained during the detection. The desired amount of light received or output voltage can thus be detected by controlling the light-emitting devices of the optical sensor in such a way as to achieve the calculated amount of light. Furthermore, for example, in Japanese Patent Laid-Open No. 2009-93155, a configuration is disclosed in which, when toner patterns are detected using an intermediate transfer belt, toner patterns of color developers are used as bases and a toner pattern of a black developer is superimposed upon the toner patterns of the color developers.

In these examples of the related art, in order to calculate an optimal amount of light emitted by light-emitting devices, toner patterns need to be transferred onto an intermediate transfer member, and an optical sensor needs to detect the toner patterns. That is, in an image forming apparatus, it takes some time to remove the toner patterns from the intermediate transfer member after performing an initial operation before the transfer of the toner patterns, transferring the toner patterns onto the intermediate transfer member, and detecting the toner patterns using the optical sensor. This period of time is a waiting time of a user. In addition, if, as in the examples of the related art, an optical sensor that detects diffuse reflection light detects toner patterns transferred onto a surface of an intermediate transfer member whose diffuse reflectance is high, a difference between an output for the toner patterns and an output for the surface of the intermediate transfer member is small, thereby decreasing a signal-to-noise (SN) ratio of a sensor output. If the SN ratio of the sensor output decreases, erroneous detection of the toner patterns might occur when noise is caused by a stain on the surface of the intermediate transfer member, variation in the amount of toner transferred at an end of a toner pattern, or the like. In this case, it is difficult to detect the toner pattern reliably and accurately.

SUMMARY OF THE INVENTION

Aspects of the present invention generally aim to reduce the waiting time of the user while accurately detecting the amount of misregistration and the amount of variation in density.

An image forming apparatus includes a rotary member configured to bear a toner image or a recording material, an image forming unit configured to form a detection pattern on the rotary member, the detection pattern being a toner image for detecting an amount of misregistration or an amount of variation in density, a detection unit including a light-emitting device that emits light onto the rotary member or the detection pattern and a light-receiving device that receives light reflected from the rotary member or the detection pattern, and a control unit configured to perform misregistration correction or density correction based on a result of the detection performed by the detection unit. The control unit determines, based on a result of the detection performed by the detection unit on the rotary member when the light-emitting device emits a predetermined first amount of light, a second amount of light the light-emitting device emits when the detection unit detects the detection pattern.

Further features of the present disclosure will become apparent from the following description of exemplary embodiments with reference to the attached drawings.

DESCRIPTION OF THE EMBODIMENTS

Exemplary embodiments will be described in detail hereinafter with reference to the drawings.

First Exemplary Embodiment

Image Forming Apparatus

Figure 1A:
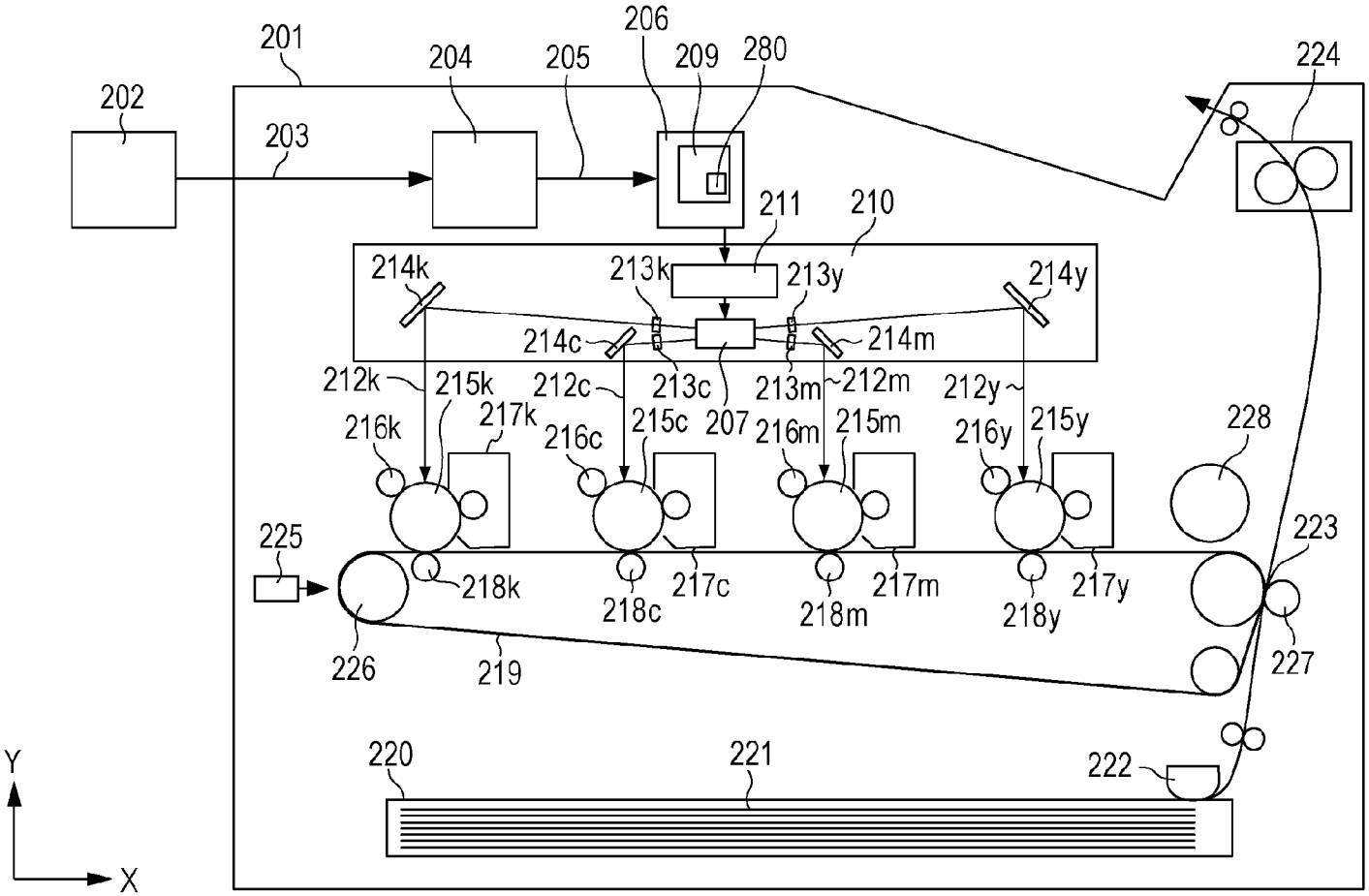
FIG. 1A is a diagram illustrating an overall configuration of a printer according to a first embodiment to a third embodiment.

FIG. 1A is a schematic cross-sectional view of the configuration of a color laser printer, which is an image forming apparatus according to a first exemplary embodiment. A color laser printer (hereinafter simply referred to as a "printer") 201 includes image forming units for four colors in order to superimpose images of four colors upon one another and form a color image. In the present embodiment, the four colors are yellow (Y), magenta (M), and cyan (C), which are chromatic colors, and black (K), which is an achromatic color. If the printer 201 receives image data 203 from a host computer 202, the printer 201 converts, using a controller 204 therein, the received image data 203 into data in a certain video signal format to generate a video signal 205 for forming an image. An engine control unit 206 includes a central processing unit (CPU) 209 (hereinafter referred to as a "CPU 209"), which is a control unit, or the like. The controller 204 outputs the generated video signal 205 to the engine control unit 206. A plurality of laser diodes 211, which are light-emitting devices, provided inside a scanner unit 210, which is an exposure unit, are driven in accordance with the video signal 205. Laser beams 212*y*, 212*m*, 212*c*, and 212*k* emitted by the plurality of laser diodes 211 are radiated onto photosensitive drums 215*y*, 215*m*, 215*c*, and 215*k*, respectively. Here, y, m, c, and k denote yellow (Y), magenta (M), cyan (C), and black (K), respectively, and are omitted in the following description unless necessary. More specifically, the laser beams 212 are radiated onto the photosensitive drums 215, which are image bearing members, through a polygon mirror 207, lenses 213, and reflection mirrors 214.

The photosensitive drums 215 are charged by chargers 216 at a desired amount of charge. By radiating the laser beams 212 and reducing surface potentials in some portions, electrostatic latent images are formed on surfaces of the photosensitive drums 215. Developing units 217 develop the electrostatic latent images formed on the photosensitive drums 215 to form toner images on the photosensitive drums 215. By applying appropriate transfer voltage to primary transfer members 218, which are transfer units, the toner images formed on the photosensitive drums 215 are transferred onto an endless belt (hereinafter referred to as an "intermediate transfer belt") 219, which is a rotary member, in a primary transfer section. During the transfer performed by the primary transfer members 218, first, a yellow image is transferred onto the intermediate transfer belt 219, and then other toner images, namely magenta, cyan, and black images, are sequentially superimposed upon the yellow image to form a color image. The intermediate transfer belt 219 is conveyed by a driving roller 226.

A recording sheet 221, which is a recording material, stored in a cassette 220 is fed by a feed roller 222. The recording sheet 221 is then conveyed to a secondary transfer unit 223 in synchronization with a toner image transferred onto the intermediate transfer belt 219, and the toner image is transferred onto the recording sheet 221. Thus, a full color toner image is transferred onto the recording sheet 221. At this time, appropriate secondary transfer voltage is applied to a secondary transfer roller 227 to increase a transfer efficiency. The recording sheet 221 onto which the toner image, which has not been fixed yet, has been transferred by the secondary transfer roller 227 is subjected to thermal fixing, in which heat and pressure are applied, in a fixing unit 224, in order to securely fix the color image on the recording sheet 221. After the thermal fixing, the recording sheet 221 is discharged from a discharge unit. A cleaning device 228 is a device that removes toner remaining on the intermediate transfer belt 219 after the transfer onto the recording sheet 221.

An optical sensor unit (hereinafter referred to as an "optical sensor") 225, which is a detection unit, detects misregistration detection toner patterns for detecting misregistration and density variation detection toner patterns for detecting the amount of variation in density of each image transferred onto the intermediate transfer belt 219. The misregistration detection toner patterns for the four colors (also referred to as "inter-color misregistration detection patterns") and the density variation detection toner patterns will be collectively referred to as "correction patterns". The correction patterns include a toner pattern of each color or tone. If a toner pattern of a certain color is referred to, for example, a term "black toner pattern" or the like is used. The optical sensor 225 detects, at a certain timing, a position of the correction pattern of each color formed on the intermediate transfer belt 219 and a difference from a target density and outputs results of the detection to the CPU 209. The CPU 209 saves the results of the detection input from the optical sensor 225 to a random-access memory (RAM) 280, which is a storage unit. Thus, by feeding results of detection performed by the optical sensor 225 back to the engine control unit 206, misregistration of each toner image in a main scanning direction and a sub-scanning direction and density of each color are corrected.

Although a color image forming apparatus including the intermediate transfer belt 219 will be described hereinafter in the present embodiment, in another exemplary embodiment, a color image forming apparatus includes a conveyor belt that conveys the recording sheet 221. This holds true for other additional exemplary embodiments. In this case, correction patterns are formed on the conveyor belt. A direction in which the recording sheet 221 is conveyed will be referred to as a "sub-scanning direction", and a direction in which the laser beams 212 scan on the photosensitive drums 215, which is a direction perpendicular to the sub-scanning direction, will be referred to as a "main scanning direction". Furthermore, the main scanning direction is defined as a Z-axis direction (refer to FIG. 1B). A direction in which the intermediate transfer belt 219 moves in the primary transfer section in FIGS. 1A and 1B is defined as an X-axis direction (actually moves in a −X direction), and a direction perpendicular to the X-axis direction and the Z-axis direction is defined as a Y-axis direction.

Configuration of Optical Sensor

Figure 1B:
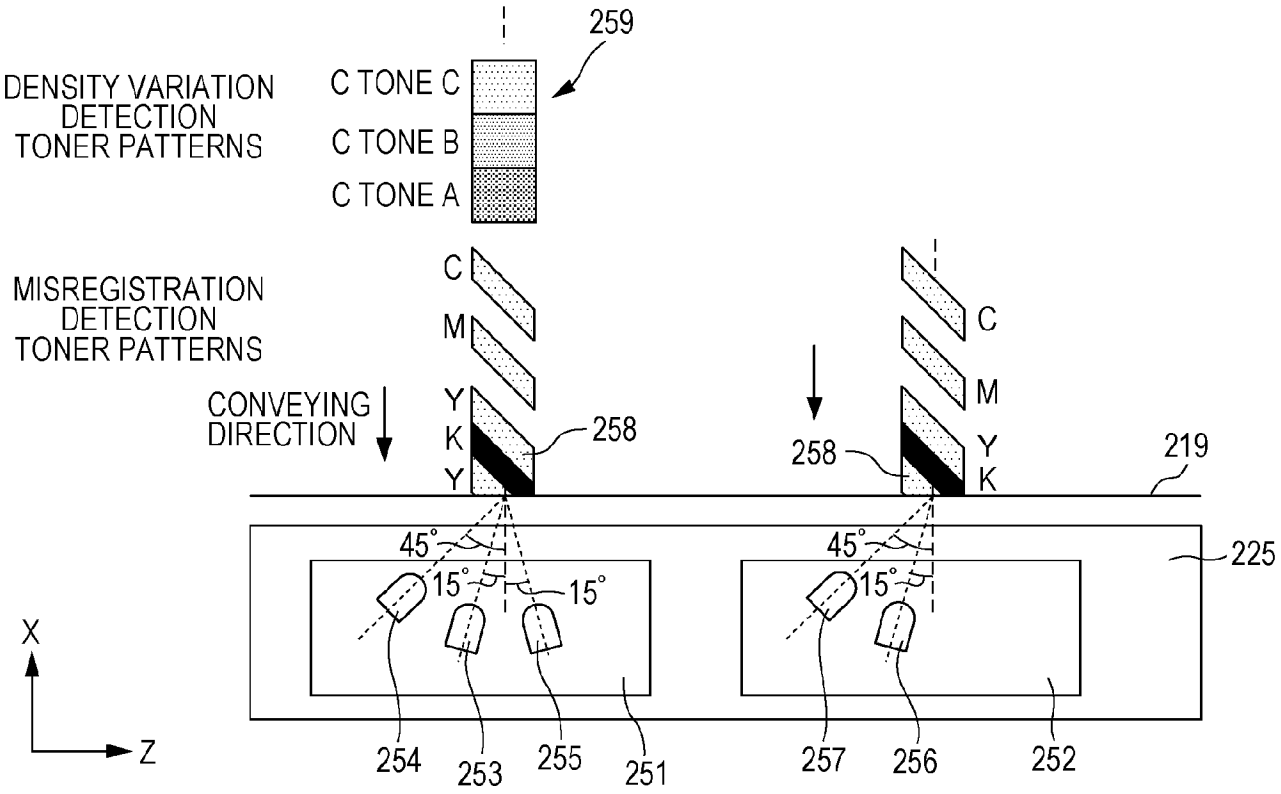
FIG. 1B is a diagram illustrating an optical sensor and correction toner patterns.

FIG. 1B is a plan view of the optical sensor 225 and the correction patterns formed on the intermediate transfer belt 219. The optical sensor 225 includes left and right sensors arranged adjacent to each other in the Z-axis direction. One of the two sensors is a sensor 251 that detects left correction patterns illustrated in FIG. 1B, and the other sensor is a sensor 252 that detects right correction patterns illustrated in FIG. 1B. By providing two or more sensors, in this case the sensors 251 and 252, in the Z-axis direction, the magnification of a toner image in the main scanning direction and the inclination of the toner image in the sub-scanning direction can be detected.

Light-emitting devices 253 and 256, which are light-emitting units, are infrared light-emitting devices that are light-emitting diodes (LEDs). The light-emitting devices 253 and 256 are inclined 15° in a −Z direction from an axis parallel to the X axis (hereinafter simply referred to as an "X axis") (broken line). Light-receiving devices 254 and 257, which are light-receiving units that are phototransistors or the like, are infrared light-receiving devices. The light-receiving devices 254 and 257 are inclined from the X axis in the same direction as the light-emitting devices 253 and 256. More specifically, the light-receiving devices 254 and 257 are inclined 45° from the X axis in the −Z direction. The light-receiving devices 254 and 257 are diffuse-reflection-light receiving devices that receive diffuse reflection light (irregular reflection light). A light-receiving device 255 is inclined from the X axis in a direction opposite to that in which the light-emitting device 253 is inclined. More specifically, the light-receiving device 255 is inclined 15° from the X axis in a +Z direction. The light-receiving device 255 is a specular-reflection-light receiving device that receives specular reflection light (regular reflection light).

Misregistration detection toner patterns 258 are patterns that are inclined from the Z axis, that are transferred onto the intermediate transfer belt 219, and that are used for detecting the amount of misregistration. As illustrated in FIG. 1B, in the misregistration detection toner patterns 258, yellow (Y), black (K), yellow (Y), magenta (M), and cyan (C) toner patterns are formed in this order in a conveying direction. The black toner patterns are superimposed upon the yellow toner patterns, which are realized by a chromatic developer, in order to distinguish diffuse reflection light from the black toner patterns from diffuse reflection light reflected from a surface of the intermediate transfer belt 219. Although the black toner patterns are superimposed upon the yellow toner patterns in the present embodiment, the black toner patterns may be superimposed upon the magenta or cyan toner patterns, instead. Furthermore, certain gaps are provided between the yellow toner patterns and the magenta toner patterns and between the magenta toner patterns and the cyan toner patterns so that reflection light from the intermediate transfer belt 219 can be detected.

Density variation detection toner patterns 259 are patterns parallel to the Z axis and used for detecting the amount of variation in density. The density variation detection toner patterns 259 include a plurality of toner patterns of different tones for each color. For example, FIG. 1B illustrates cyan toner patterns of different tones, namely C Tone A, C Tone B, and C Tone C. A plurality of toner patterns of different tones are provided for each of the colors of yellow, magenta, cyan, and black.

The light-receiving devices 254 and 257 receive diffuse reflection light of infrared light emitted by the light-emitting devices 253 and 256, respectively, the diffuse reflection light being reflected from the surface of the intermediate transfer belt 219 and the misregistration detection toner patterns 258 transferred onto the intermediate transfer belt 219. Thus, the light-receiving devices 254 and 257 detect positions of the misregistration detection toner patterns 258. In addition, the light-receiving device 254 receives diffuse reflection light from the intermediate transfer belt 219 and the density variation detection toner patterns 259 transferred onto the intermediate transfer belt 219, and the light-receiving device 255 receives specular reflection light. Thus, the light-receiving devices 254 and 255 detect the amount of variation in the densities of the density variation detection toner patterns 259 in density from a certain value.

Driving Circuit for Optical Sensor

Figure 2A:
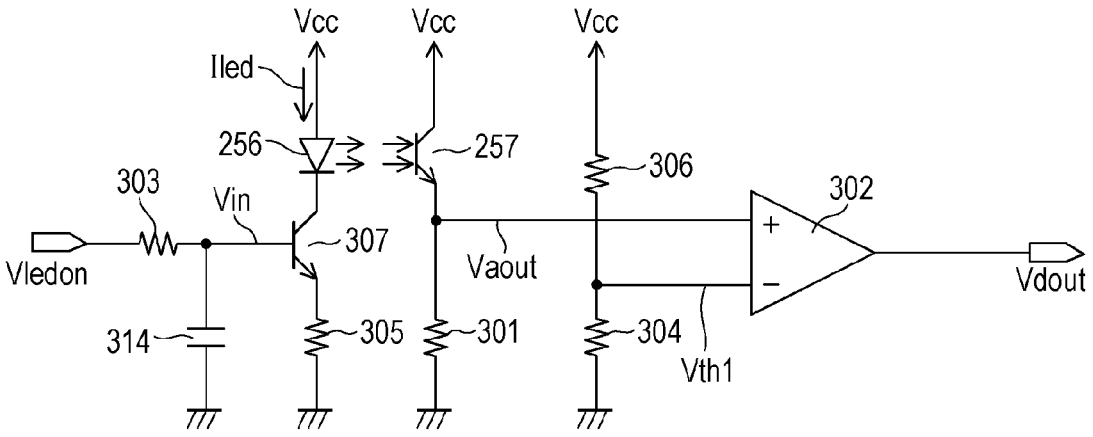
FIG. 2A is a diagram illustrating a driving circuit of an optical sensor according to the first and second embodiments.

FIG. 2A illustrates a driving circuit for the sensor 252 of the optical sensor 225. A driving signal Vledon output from the CPU 209 is a rectangular wave signal whose duty ratio can be changed. A misregistration detection threshold voltage Vth1, which is a first threshold, is a threshold voltage of a comparator 302 and will be simply referred to as a "threshold voltage Vth1" hereinafter. A voltage Vin is a voltage obtained by smoothing rectangular wave voltage of the driving signal Vledon using a resistor 303 and a capacitor 314 and applied to a base terminal of a transistor 307. A voltage Vaout is an analog output voltage generated when the light-receiving device 257 receives diffuse reflection light from the correction patterns on the intermediate transfer belt 219 and current generated as a result of photoelectric conversion flows into a resistor 301. A voltage Vdout is a digital output voltage obtained by binarizing the analog output voltage Vaout using the comparator 302. A current Iled is a current flowing into the light-emitting device 256.

When the duty ratio of the driving signal Vledon output from the CPU 209 is changed, the smoothed voltage Vin changes in accordance with characteristics that will be described later. If the voltage Vin changes, a voltage applied to a resistor 305 connected to an emitter terminal of the transistor 307 changes, which makes it possible to change the current Iled flowing into the light-emitting device 256. A cathode of the light-emitting device 256 is connected to a collector terminal of the transistor 307. Infrared light emitted by the light-emitting device 256 is reflected from the intermediate transfer belt 219 and the misregistration detection toner patterns 258. The light-receiving device 257 detects diffuse reflection light of the infrared light. A current according to the detected amount of reflection light flows into the resistor 301, thereby realizing photoelectric conversion. A resultant voltage is thus detected as the analog output voltage Vaout.

The threshold voltage Vth1, which is obtained by dividing a power supply voltage Vcc using voltage dividers 304 and 306, is input to a negative input terminal of the comparator 302, and the detected analog output voltage Vaout is input to a positive input terminal. The comparator 302 converts the input voltage into the digital output voltage Vdout and outputs the digital output voltage Vdout to the CPU 209. The CPU 209 detects a timing at which the input digital output voltage Vdout changes from a high level to a low level or from the low level to the high level. The CPU 209 then sequentially stores, in the RAM 280, information regarding a time difference between a timing 902 (refer to FIG. 9) at which an image data output start signal, which will be described later, is output and each operation timing. The analog output voltage Vaout is output to a terminal capable of detecting the analog output voltage Vaout as an analog value of the CPU 209. The CPU 209 detects, using the optical sensor 225, the misregistration detection toner patterns 258, the density variation detection toner patterns 259, and the surface of the intermediate transfer belt 219 onto which no toner pattern is transferred. The CPU 209 stores a value of the analog output voltage Vaout at a time when the optical sensor 225 detects the misregistration detection toner patterns 258, the density variation detection toner patterns 259, or the surface of the intermediate transfer belt 219 in the RAM 280. The configuration of a driving circuit for the sensor 251 is the same as that of the driving circuit for the sensor 252, and accordingly description thereof is omitted.

Pulse Duty and LED Current Characteristics

Figure 2B:
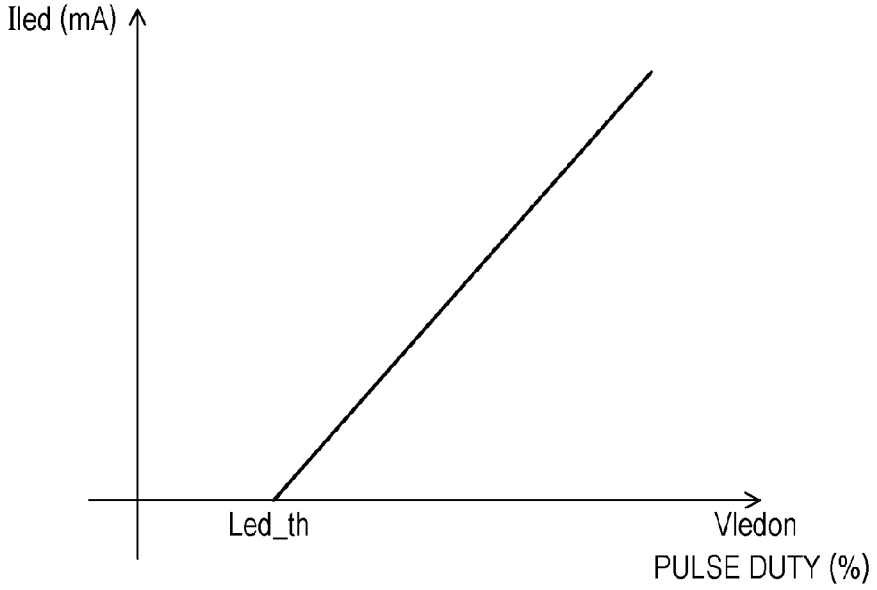
FIG. 2B is a graph illustrating characteristics of currents flowing into light-emitting devices according to the first to third embodiments.

FIG. 2B is a graph illustrating output characteristics of the currents Vledon flowing into the light-emitting devices 253 and 256 against the duty ratio of the rectangular wave of the driving signal Vledon output to the driving circuits in the optical sensor 225. A horizontal axis represents the duty ratio (indicated as "Vledon pulse duty") (%) of the rectangular wave of the driving signal Vledon output to the driving circuits in the optical sensor 225 from the CPU 209. A vertical axis represents the current Iled [mA] flowing into the light-emitting devices 253 and 256. An intercept Led_th on the horizontal axis is a value at which the current Iled begins to flow into the light-emitting devices 253 and 256 in the driving circuits in the optical sensor 225. If the duty ratio of the rectangular wave of the driving signal Vledon is increased, the smoothed voltage Vin increases. If the duty ratio of the driving signal Vledon exceeds the intercept Led_th, the transistor 307 turns on because of characteristics of the transistor 307 of each driving circuit, and the current begins to flow into the light-emitting devices 253 and 256. If the duty ratio of the rectangular wave of the driving signal Vledon further increases and accordingly the voltage Vin increases, the current Iled flowing into the light-emitting devices 253 and 256 further increases.

System Diagram of Image Forming Apparatus

Figure 3A:
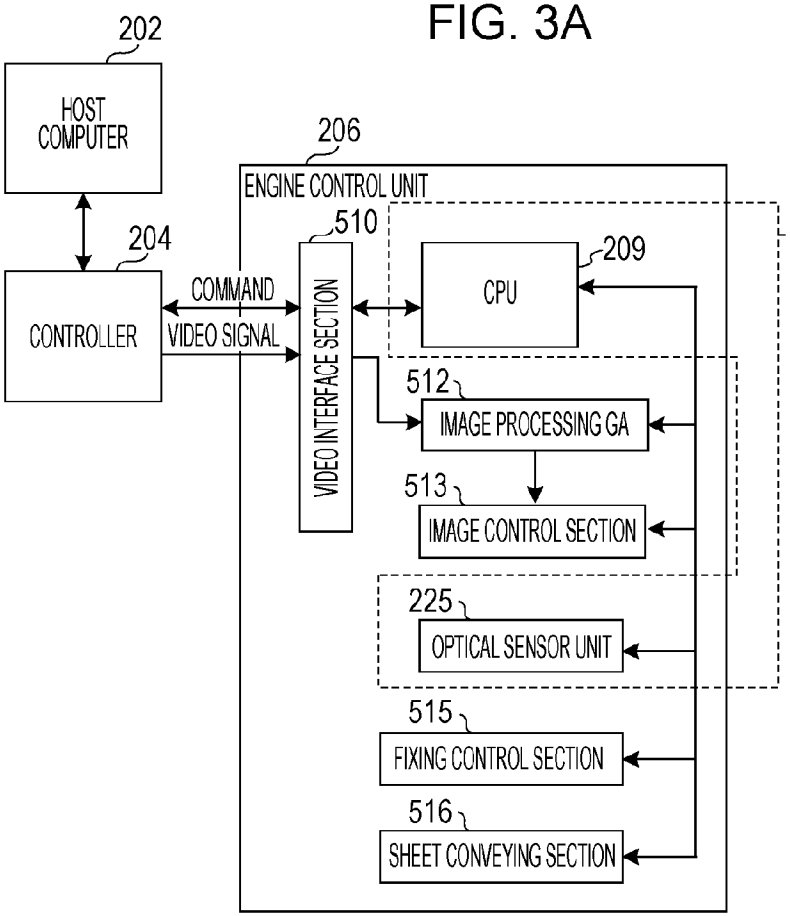
FIGS. 3A and 3B are schematic system diagrams illustrating an image forming apparatus according to the first to third embodiments.
Figure 3B:
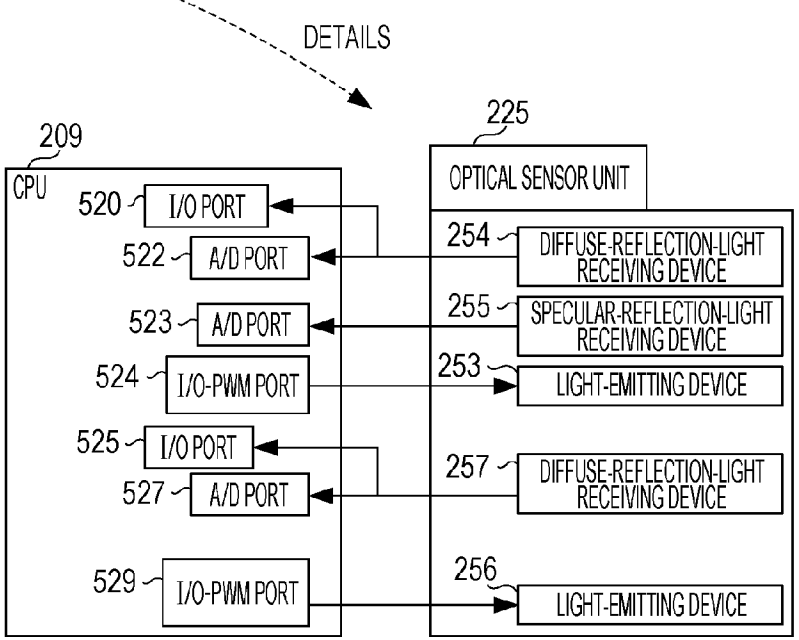

FIGS. 3A and 3B are block diagrams illustrating details of the CPU 209 and the optical sensor 225. FIG. 3A is a block diagram illustrating the entirety of the engine control unit 206 and the like, and FIG. 3B is a block diagram illustrating details of the CPU 209 and the optical sensor 225. The controller 204 is capable of communicating with the host computer 202 and the engine control unit 206. The controller 204 receives image information and a printing command from the host computer 202 and analyzes the received image information to convert the image information into bit data. The controller 204 then transmits a printing reservation command, a printing start command, and a video signal to the CPU 209 and an image processing gate array (GA) 512 through a video interface section 510. The controller 204 transmits the printing reservation command to the CPU 209 through the video interface section 510 in accordance with the printing command from the host computer 202 and then transmits the printing start command to the CPU 209 after printing becomes possible. The CPU 209 prepares for printing in order of printing reservation commands from the controller 204 and waits for the printing start command from the controller 204. Upon receiving the printing start command, the CPU 209 instructs, in accordance with information included in the printing reservation commands, control sections (an image control section 513, a fixing control section 515, and a sheet conveying section 516) to start a printing operation.

Upon being instructed to start the printing operation, the image control section 513 begins to prepare for image formation. After the CPU 209 receives, from the image control section 513, information indicating that the image control section 513 is ready for the image formation, the CPU 209 outputs, to the controller 204, a /TOP signal, which indicates a reference timing at which the video signal is output. Upon receiving the /TOP signal from the CPU 209, the controller 204 outputs the video signal in accordance with the /TOP signal. Upon receiving the video signal from the controller 204, the image processing GA 512 transmits image formation data to the image control section 513. The image control section 513 forms an image based on the image formation data received from the image processing GA 512. Upon being instructed to start the printing operation, the sheet conveying section 516 begins a feeding operation. Upon being instructed to start the printing operation, the fixing control section 515 prepares for fixing. The fixing control section 515 begins to control temperature in accordance with information included in the printing reservation command in synchronization with a timing at which a recording sheet 221 onto which an image has been transferred is conveyed. The fixing control section 515 fixes the image on the recording sheet 221 and discharges the recording sheet 221 from the image forming apparatus.

The CPU 209 outputs, from input/output pulse width modulation (I/O-PWM) ports 524 and 529, driving signals Vledon to the driving circuits in the optical sensor 225. More specifically, the CPU 209 outputs a driving signal Vledon from the I/O-PWM port 524 to control the current flowing into the light-emitting device 253. The CPU 209 outputs a driving signal Vledon from the I/O-PWM port 529 to control the current flowing into the light-emitting device 256. The light-receiving devices 254 and 257 detect diffuse reflection light from the intermediate transfer belt 219 and the correction patterns and output digital output voltages Vdout, which are obtained by binarizing the diffuse reflection light through photoelectric conversion performed by the driving circuits, to input/output (I/O) ports 520 and 525. More specifically, the light-receiving device 254 outputs a result of the detection to the I/O port 520 of the CPU 209, and the light-receiving device 257 outputs a result of the detection to the I/O port 525 of the CPU 209.

The CPU 209 detects points at which values input to the I/O ports 520 and 525 change as boundaries between the correction patterns and the intermediate transfer belt 219. The CPU 209 calculates the amount of misregistration between the toner patterns of different colors based on the detected boundaries between the correction patterns and the intermediate transfer belt 219. The light-receiving devices 254, 255, and 257 output analog output voltages Vaout, which have been obtained as a result of photoelectric conversion performed by the driving circuits, to analog-to-digital (A/D) ports 522, 523, and 527, respectively, of the CPU 209. More specifically, the light-receiving device 254 outputs an analog output voltage Vaout, which is a detected voltage, to the A/D port 522 of the CPU 209, and the light-receiving device 257 outputs an analog output voltage Vaout, which is a detected voltage, to the A/D port 527 of the CPU 209. The light-receiving device 255 outputs an analog output voltage Vaout, which is a detected voltage, to the A/D port 523 of the CPU 209.

The CPU 209 calculates the amount of variation in density based on the detected voltages of diffuse reflection light and the detected voltage of specular reflection light input to the A/D ports 522, 523, and 527. The CPU 209 then controls the currents flowing into the light-emitting devices 253 and 256 based on the detected voltages input to the A/D ports 522, 523, and 527 in such a way as to achieve the amount of light emitted calculated using a calculation method that will be described later. That is, the CPU 209 changes the duty ratios of the rectangular waves of the driving signals Vledon output from the I/O-PWM ports 524 and 529 based on the characteristic graph of FIG. 2B. Thus, the CPU 209 controls the currents flowing into the light-emitting devices 253 and 256 to control the amount of light emitted by the light-emitting devices 253 and 256.

Figure 4:
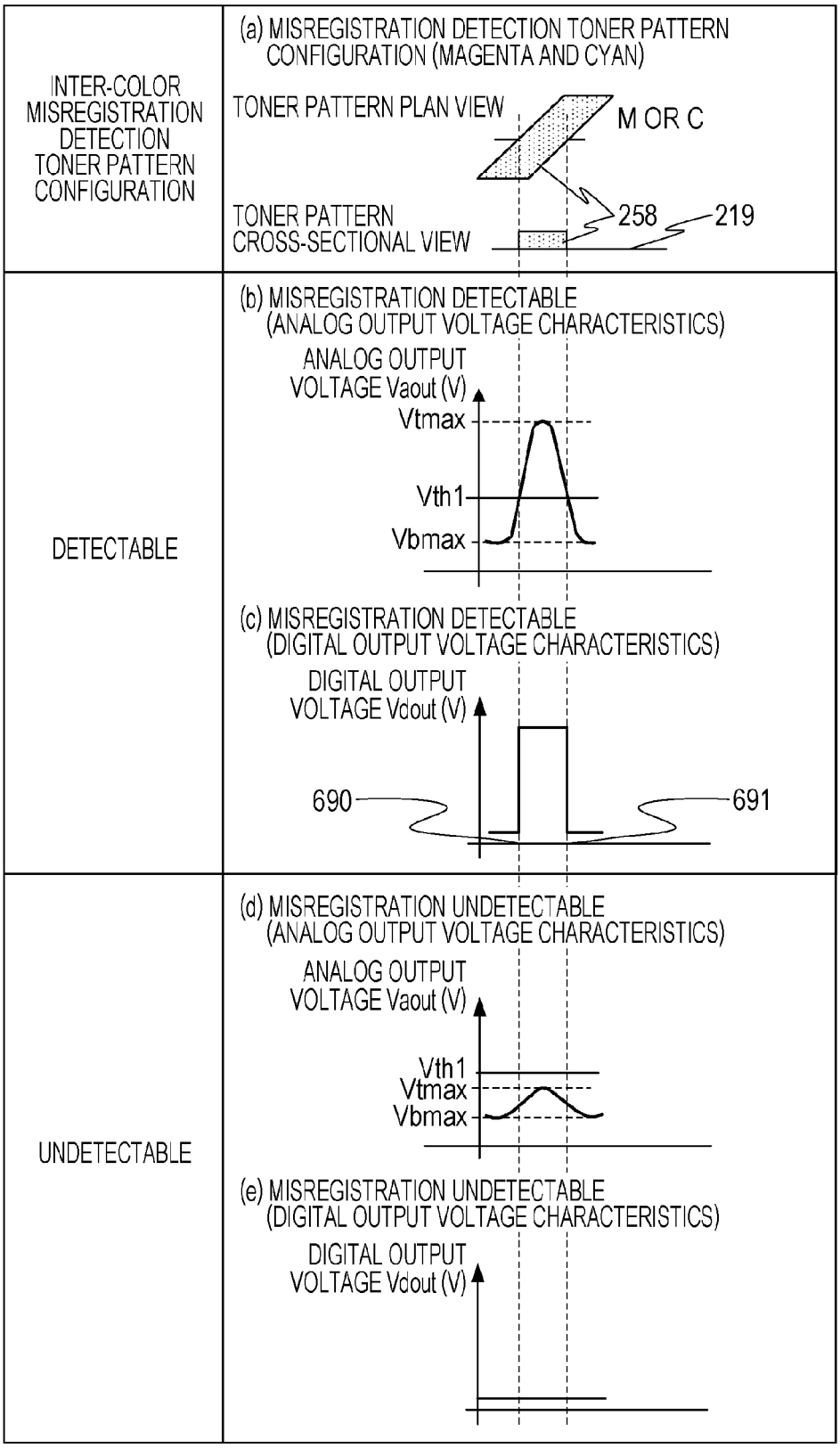
FIG. 4 is a diagram illustrating first detection conditions under which misregistration detection toner patterns according to the first embodiment can be detected.
Figure 5:
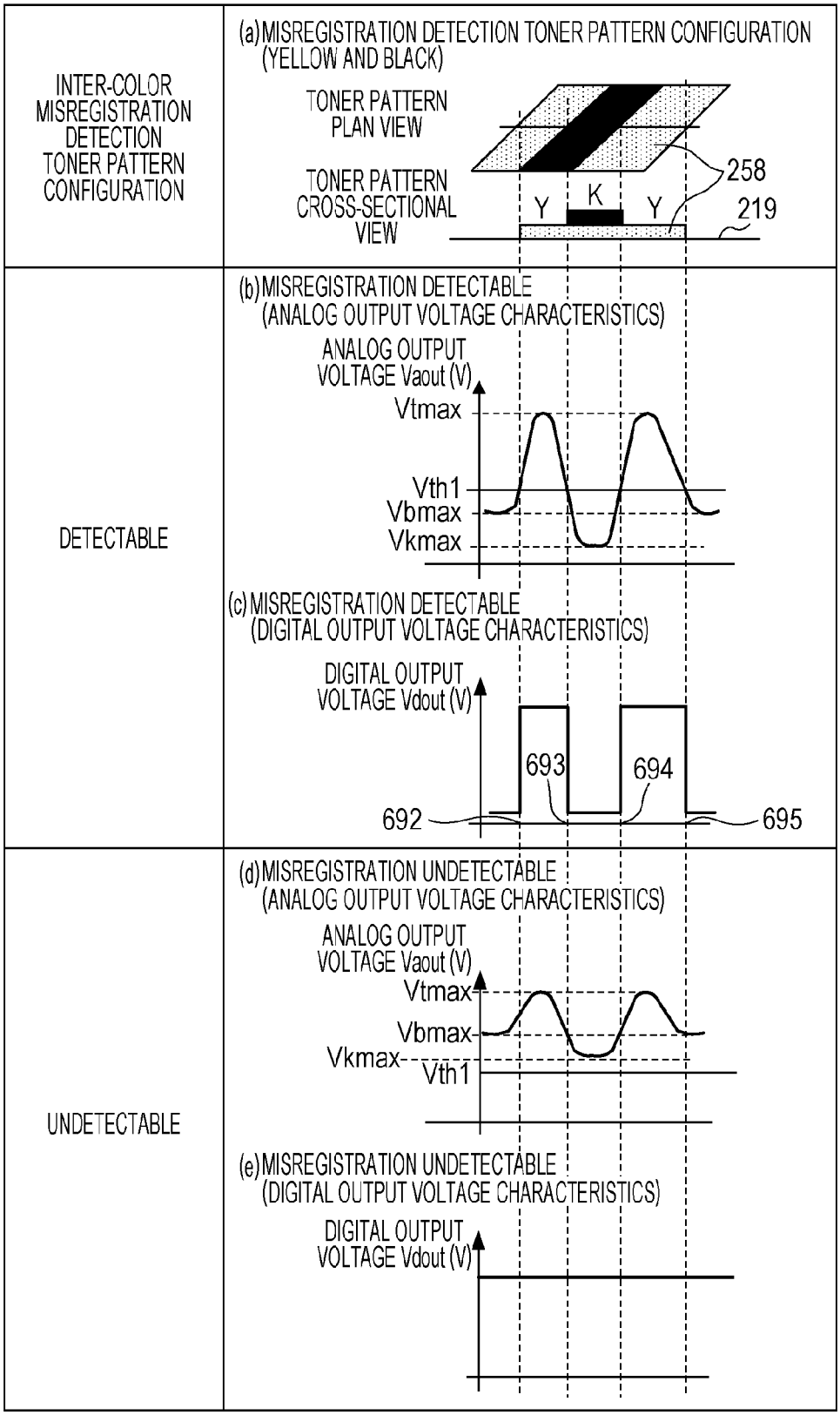
FIG. 5 is a diagram illustrating second detection conditions under which the misregistration detection toner patterns according to the first embodiment can be detected.
Figure 6:
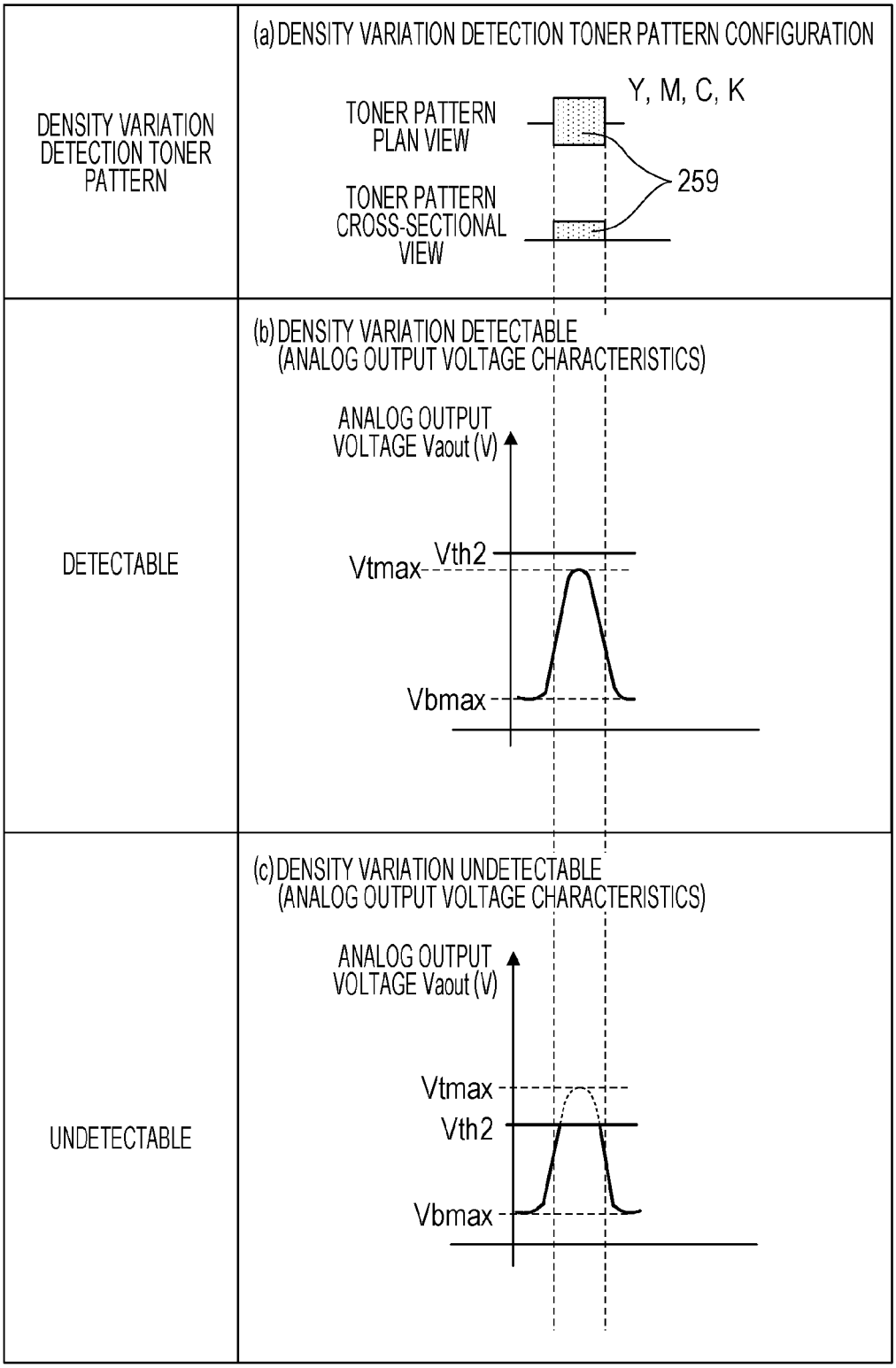
FIG. 6 is a diagram illustrating detection conditions under which density variation detection toner patterns according to the first embodiment can be detected.

Outputs and Detection Conditions During Detection of Amount of Misregistration and Amount of Variation in Density First Misregistration Detection Conditions In the present embodiment, a diffuse reflectance of the intermediate transfer belt 219 is higher than a diffuse reflectance of the black toner patterns, which have an achromatic color, but lower than diffuse reflectances of the other chromatic (yellow, magenta, and cyan) toner patterns. FIG. 4 is a schematic diagram illustrating conditions under which the optical sensor 225 can appropriately detect the amount of misregistration when the optical sensor 225 detects, among the toner patterns included in the misregistration detection toner patterns 258, a magenta or cyan toner pattern. FIG. 4 illustrates, from top to bottom, the configuration of the misregistration detection toner patterns 258 for detecting misregistration between the toner patterns of different colors, a case in which the optical sensor 225 can detect the amount of misregistration, and a case in which it is difficult for the optical sensor 225 to detect the amount of misregistration. FIGS. 5 and 6, which will be referred to later, illustrate similar content. FIG. 6 illustrates the configuration of the density variation detection toner pattern 259.

First conditions (first misregistration detection conditions) under which the optical sensor 225 can detect the amount of misregistration will be described. A part (a) of FIG. 4 includes a plane view and a cross-sectional view of the magenta and cyan toner patterns transferred onto the surface of the intermediate transfer belt 219. As described with reference to FIG. 1B, the magenta and cyan toner patterns are provided with certain gaps that separate the magenta and cyan toner patterns from the other toner patterns. When the optical sensor 225 detects the toner patterns, therefore, the optical sensor 225 detects the surface of the intermediate transfer belt 219, the magenta or cyan toner pattern, and the surface of the intermediate transfer belt 219 in this order.

A part (b) of FIG. 4 includes a diagram illustrating characteristics of the analog output voltage Vaout (V) at a time when the optical sensor 225 can detect the amount of misregistration when the optical sensor 225 detects the toner pattern illustrated in the part (a) of FIG. 4. In the part (b) of FIG. 4, a solid line indicates the threshold voltage Vth1. A part (c) of FIG. 4 includes a diagram illustrating characteristics of the digital output voltage Vdout(V), which is obtained by binarizing the analog output voltage Vaout illustrated in the part (b) of FIG. 4, at a time when the optical sensor 225 can detect the amount of misregistration. A voltage Vtmax, which is indicated by a broken line, is a highest analog output voltage at a time when the optical sensor 225 detects the magenta or cyan toner pattern. A lowest analog output voltage is a voltage Vtmin. Furthermore, a voltage Vbmax, which is indicated by a broken line, is an analog output voltage at a time when the optical sensor 225 detects the surface of the intermediate transfer belt 219. Here, the voltage Vtmin is higher than the voltage Vbmax (Vtmin>Vbmax).

In the part (b) of FIG. 4, a maximum value of the analog output voltage Vaout, while the optical sensor 225 is detecting the surface of the intermediate transfer belt 219 without any toner pattern, is the voltage Vbmax. If the optical sensor 225 detects the toner pattern, the analog output voltage Vaout increases and becomes greater than or equal to the threshold voltage Vth1 (Vaout≥Vth1) and reaches the maximum value Vtmax (Vtmax>Vth1). Next, if the optical sensor 225 detects the surface of the intermediate transfer belt 219 again at a trailing end of the toner pattern, the analog output voltage Vaout decreases and falls below the threshold voltage Vth1 (Vaout<Vth1) and returns to the voltage Vbmax, which is the voltage obtained while the optical sensor 225 is detecting the surface of the intermediate transfer belt 219.

In the part (c) of FIG. 4, at a timing 690, at which the analog output voltage Vaout exceeds the threshold voltage Vth1 in the part (b) of FIG. 4, the digital output voltage changes from the low level to the high level. Next, at a timing 691, at which the analog output voltage Vaout falls below the threshold voltage Vth1, the digital output voltage Vdout changes from the high level to the low level. The CPU 209 includes a timer (not illustrated) that measures timings at which the digital output voltage Vdout changes. The CPU 209 calculates a temporal midpoint between the timings 690 and 691, at which the digital output voltage Vdout changes between the high level and the low level, as a center position of the magenta or cyan toner pattern. The CPU 209 then calculates a time difference between a timing 902 (refer to FIG. 9), at which an image data output start signal, which will be described later, is output, and the calculated temporal midpoint, which corresponds to the center position of the toner pattern, and stores information regarding the time difference in the RAM 280. Because a moving speed of the intermediate transfer belt 219 is known in advance, the calculated time difference can be converted into the amount of misregistration. In the following description, a time difference is used as a value having the same meaning as the amount of misregistration. The CPU 209 compares the information regarding the time difference stored in the RAM 280 with a certain value and calculates the amount of misregistration of each toner pattern. Thus, the CPU 209 calculates a position of each toner pattern based on the timings at which the digital output voltage Vdout changes in order to calculate the amount of misregistration of each toner pattern.

A part (d) of FIG. 4 illustrates characteristics of the analog output voltage Vaout at a time when it is difficult for the optical sensor 225 to detect the amount of misregistration when the optical sensor 225 detects the toner pattern illustrated in the part (a) of FIG. 4. A part (e) of FIG. 4 illustrates characteristics of the digital output voltage Vdout, which is obtained by binarizing the analog output voltage Vaout illustrated in the part (d) of FIG. 4, at a time when it is difficult for the optical sensor 225 to detect the amount of misregistration. In the part (d) of FIG. 4, the analog output voltage Vaout changes as in the part (b) of FIG. 4, but, for example, if the toner pattern is pale, the voltage Vtmax, which is indicated by a broken line, is lower than the threshold voltage Vth1 (Vtmax<Vth1). In the part (e) of FIG. 4, since the analog output voltage Vaout does not exceed the threshold voltage Vth1 even at its maximum value Vtmax in the part (d) of FIG. 4, the digital output voltage Vdout remains at the low level. The CPU 209 does not, therefore, detect a point at which the digital output voltage Vdout changes between the high level and the low level, and accordingly does not detect a position of the toner pattern.

Second Misregistration Detection Conditions

Second conditions (second misregistration detection conditions) under which the optical sensor 225 can detect the amount of misregistration will now be described. FIG. 5 is a diagram illustrating conditions under which the optical sensor 225 can appropriately detect the amount of misregistration when the optical sensor 225 detects the yellow and black toner patterns. A part (a) of FIG. 5 includes a plane view and a cross-sectional view of the yellow and black toner patterns transferred onto the surface of the intermediate transfer belt 219. As illustrated in the cross-sectional view included in the part (a) of FIG. 5, the black toner pattern is superimposed upon the yellow toner pattern. In the present embodiment, the diffuse reflectance of the intermediate transfer belt 219 is higher than the diffuse reflectance of the black toner pattern. In the present embodiment, as described later, the maximum value Vbmax of the analog output voltage Vaout, when the optical sensor 225 detects the surface of the intermediate transfer belt 219, needs to be lower than the threshold voltage Vth1, in order to detect the amount of misregistration correctly.

If the voltage Vbmax exceeds the threshold voltage Vth1, it is difficult to correctly detect positions of the chromatic toner patterns, namely the yellow, magenta, and cyan toner patterns. On the other hand, if the black toner pattern is transferred onto the intermediate transfer belt 219, the voltage Vbmax needs to be higher than the threshold voltage Vth1 in order to detect a position of the black toner pattern correctly. As described above, in order to detect the amount of misregistration of the chromatic toner patterns correctly, the voltage Vbmax needs to stay lower than the threshold Vth1. In the present embodiment, therefore, the black toner pattern is superimposed upon the yellow toner pattern, and the optical sensor 225 detects these toner patterns. By superimposing the black toner pattern upon the yellow toner pattern, the CPU 209 can detect, as described later, a point at which the digital output voltage Vdout changes while the optical sensor 225 is detecting the toner patterns.

A part (b) of FIG. 5 illustrates characteristics of the analog output voltage Vaout at a time when the optical sensor 225 can detect the amount of misregistration when the optical sensor 225 detects the toner patterns illustrated in the part (a) of FIG. 5. A part (c) of FIG. 5 illustrates characteristics of the digital output voltage Vdout, which is obtained by binarizing the analog output voltage Vaout illustrated in the part (b) of FIG. 5, at a time when the optical sensor 225 can detect the amount of misregistration. In the part (b) of FIG. 5, a voltage Vkmax is a maximum value of the analog output voltage Vaout at a time when the optical sensor 225 detects the black toner pattern. A maximum value of the analog output voltage Vaout while the optical sensor 225 is detecting the surface of the intermediate transfer belt 219 without any toner pattern is denoted by Vbmax. If the optical sensor 225 detects the yellow toner pattern, the analog output voltage Vaout increases and becomes equal to or higher than the threshold voltage Vth1 (Vaout≥Vth1) and reaches the voltage Vtmax. In the present embodiment, since the diffuse reflectance of the intermediate transfer belt 219 is higher than the diffuse reflectance of the black toner pattern, Vbmax>Vkmax.

Next, if the optical sensor 225 detects the black toner pattern, the analog output voltage Vaout decreases from the voltage Vtmax and falls below the threshold voltage Vth1 (Vth1>Vaout), finally reaching the voltage Vkmax (Vkmax<Vbmax<Vth1). If the optical sensor 225 detects the yellow toner pattern again, the analog output voltage Vaout increases and exceeds the threshold voltage Vth1, finally reaching the voltage Vtmax. If the optical sensor 225 detects the surface of the intermediate transfer belt 219 again, the analog output voltage Vaout decreases and falls below the threshold voltage Vth1, returning to the voltage Vbmax.

In the part (c) of FIG. 5, at a timing 692, at which the optical sensor 225 detects the yellow toner pattern and the analog output voltage Vaout exceeds the threshold voltage Vth1, the digital output voltage Vdout changes from the low level to the high level. Next, at a timing 693, at which the optical sensor 225 detects the black toner pattern and the analog output voltage Vaout falls below the threshold Vth1, the digital output voltage Vdout changes from the high level to the low level. At a timing 694, at which the optical sensor 225 detects the yellow toner pattern again and the analog output voltage Vaout exceeds the threshold voltage Vth1, the digital output voltage Vdout changes from the low level to the high level. Finally, at a timing 695, at which the optical sensor 225 detects the surface of the intermediate transfer belt 219 again and the analog output voltage Vaout decreases and falls below the threshold voltage Vth1, the digital output voltage Vdout changes from the high level to the low level.

The CPU 209 calculates, as a temporal midpoint, a center position of the yellow toner pattern based on the timings 692 and 695, at which the digital output voltage Vdout changes. In addition, the CPU 209 calculates, as a temporal midpoint, a center position of the black toner pattern based on the timings 693 and 694, at which the digital output voltage Vdout changes. As in the part (c) of FIG. 4, the CPU 209 calculates a time difference between the timing 902, at which the image data output start signal, which will be described later, is output, and the temporal midpoint, which corresponds to the center position of each toner pattern, and stores the time difference in the RAM 280. The CPU 209 thus calculates the position of each toner pattern based on the timings at which the value of the digital output voltage Vdout changes.

A part (d) of FIG. 5 illustrates characteristics of the analog output voltage Vaout at a time when it is difficult for the optical sensor 225 to detect the amount of misregistration when the optical sensor 225 detects the toner patterns illustrated in the part (a) of FIG. 5. A part (e) of FIG. 5 illustrates characteristics of the digital output voltage Vdout, which is obtained by binarizing the analog output voltage Vaout illustrated in the part (d) of FIG. 5, at a time when it is difficult for the optical sensor 225 to detect the amount of misregistration. In the part (d) of FIG. 5, if the amount of light emitted from the optical sensor 225 is large or the black toner pattern is pale, the voltages Vbmax and Vkmax increase, and Vth1<Vbmax and Vth1<Vkmax. In the part (e) of FIG. 5, the analog output voltage Vaout is constantly higher than the threshold voltage Vth1 while the optical sensor 225 is detecting the surface of the intermediate transfer belt 219 or the yellow or black toner pattern illustrated in the part (a) of FIG. 5. Consequently, the digital output voltage Vdout, undesirably, constantly remains at the high level, and the CPU 209 does not detect a point at which the digital output voltage Vdout changes from the high level to the low level or from the low level to the high level. Thus, if the voltages Vbmax and Vkmax are higher than the threshold Vth1, it is difficult for the CPU 209 to calculate the position of each toner pattern.

Density Variation Detection Conditions

Conditions (density variation detection conditions) under which the optical sensor 225 can detect the amount of variation in density will be described. FIG. 6 is a schematic diagram illustrating conditions under which the CPU 209 can appropriately detect the amount of variation in density when the optical sensor 225 detects the density variation detection toner pattern 259 of yellow, magenta, cyan, or black. A part (a) of FIG. 6 includes a plane view and a cross-sectional view of the density variation detection toner pattern 259 transferred onto the intermediate transfer belt 219. In the density variation detection toner patterns 259, the yellow, magenta, cyan, and black toner patterns have the same shape. A part (b) of FIG. 6 illustrates output characteristics of the analog output voltage Vaout at a time when the CPU 209 can detect the amount of variation in density and the optical sensor 225 detects the toner pattern illustrated in the part (a) of FIG. 6. On the other hand, a part (c) of FIG. 6 illustrates output characteristics of the analog output voltage Vaout at a time when it is difficult for the CPU 209 to detect the amount of variation in density.

In the part (b) of FIG. 6, a threshold voltage Vth2, which is a second threshold, indicated by a solid line is a maximum analog value that can be detected by the A/D ports of the CPU 209 and is a density variation detection threshold voltage. The threshold voltage Vth2 is higher than the threshold voltage Vth1. The density variation detection threshold voltage Vth2 will be simply referred to as the "threshold voltage Vth2" hereinafter. When the optical sensor 225 detects the surface of the intermediate transfer belt 219, the maximum value of the analog output voltage Vaout is the voltage Vbmax. If the optical sensor 225 detects the toner pattern illustrated in the part (a) of FIG. 6, the analog output voltage Vaout increases and reaches the maximum value Vtmax. If the optical sensor 225 detects the surface of the intermediate transfer belt 219 again, the analog output voltage Vaout decreases and returns to the voltage Vbmax. The analog output voltage Vaout is proportional to the tone of the toner pattern. The CPU 209 stores, in the RAM 280, the density of each tone of the toner pattern illustrated in the part (a) of FIG. 6 and the value of the analog output voltage Vaout at a time when the optical sensor 225 detects each toner pattern. The CPU 209 calculates the current density of each color and tone of the printer 201 based on a difference between a certain value corresponding to the density of each tone and the analog output voltage Vaout stored in the RAM 280.

In the part (c) of FIG. 6, if the amount of light emitted from the optical sensor 225 is too large, the voltage Vtmax exceeds the threshold voltage Vth2 (Vtmax>Vth2). If the voltage Vtmax exceeds the threshold voltage Vth2, the analog output voltage Vaout remains at the same value (threshold voltage Vth2). A portion of the analog output voltage Vaout indicated by a broken curve in the part (c) of FIG. 6, therefore, is not correctly detected. It is therefore difficult for the CPU 209 to correctly calculate the density of each toner pattern from the analog output voltage Vaout.

Detection Conditions

As described above, certain conditions need to be satisfied in order for the CPU 209 to detect the amount of misregistration and the amount of variation in density appropriately. More specifically, the voltages Vtmax, Vtmin, Vkmax, and Vbmax, which are the analog output voltages at a time when the optical sensor 225 detects the various detection targets, need to satisfy the following conditions 6-1 to 6-4:

Condition 1: a condition under which the chromatic (Y, M, and C) toner patterns of the misregistration detection toner patterns 258 can be detected $$Vt\ min > Vth1 \tag{6-1}$$

(the part (b) of FIG. 4)

Condition 2: conditions under which the black toner pattern of the misregistration detection toner patterns 258 can be detected $$Vk\ max < Vth1 \tag{6-2}$$

(the part (b) of FIG. 5)

$$Vb\ max < Vth1 \tag{6-3}$$

(the part (b) of FIG. 4 and the part (b) of FIG. 5)

Condition 3: a condition under which the Y, M, C, and K toner patterns of the density variation detection toner patterns 259 can be detected $$Vtmax < Vth2 \tag{6-4}$$

(the part (b) of FIG. 6)

Condition 1 might not be satisfied in the following cases. If the density of a chromatic toner pattern of the misregistration detection toner patterns 258 is low or the amount of light emitted by the light-emitting devices 253 and 256 of the optical sensor 225 is small and the detected voltage (Vtmax) does not exceed the threshold voltage Vth1, the result illustrated in the part (d) or (e) of FIG. 4 is produced. As illustrated in the part (e) of FIG. 4, since the CPU 209 does not detect an edge of the digital output voltage Vdout, the CPU 209 does not detect the amount of misregistration. With respect to Condition 2, if a black toner pattern whose diffuse reflectance is low is formed on a chromatic toner pattern (for example, a yellow toner pattern) whose diffuse reflectance is high, the following result might be produced. That is, if the density of the black toner pattern is low or the amount of light emitted by the light-emitting devices 253 and 256 of the optical sensor 225 is large, the detected voltage (Vkmax) might be higher than the threshold voltage Vth1 (the part (d) of FIG. 5). Consequently, the CPU 209 does not detect an edge of the digital output voltage Vdout and does not detect a position of the black toner pattern (the part (e) of FIG. 5). If the diffuse reflectance of the intermediate transfer belt 219 is high and the detected voltage exceeds the threshold voltage Vth1, the digital output voltage Vdout does not change, and the CPU 209 does not detect a point at which the digital Vdout changes (the part (e) of FIG. 5). With respect to Condition 3, if the amount of light emitted by the light-emitting devices 253 and 256 of the optical sensor 225 is large, the detected voltage (Vtmax) might exceed the threshold Vth2, which is a saturation voltage of A/D conversion, and the CPU 209 does not appropriately detect the amount of variation in density (the part (c) of FIG. 6).

As described in Conditions 1 to 3, if the density of a chromatic toner pattern is low and the amount of light emitted by the light-emitting devices 253 and 256 of the optical sensor 225 is small, the CPU 209 might not detect the misregistration detection toner pattern 258. In addition, if the density of the black toner pattern is low and the amount of light emitted by the light-emitting devices 253 and 256 of the optical sensor 225 is large, the CPU 209 might not detect the misregistration detection toner pattern 258. Furthermore, if the amount of light reflected from the intermediate transfer belt 219 is large, the CPU 209 might not detect the misregistration detection toner pattern 258. On the other hand, if the amount of light emitted by the light-emitting devices 253 and 256 of the optical sensor 225 is large, the CPU 209 might not detect the density variation detection toner patterns 259. That is, the light-emitting devices 253 and 256 of the optical sensor 225 need to be set such that the detection conditions 6-1 to 6-4 are satisfied. In doing so, the CPU 209 can appropriately detect both the misregistration detection toner patterns 258 and the density variation detection toner patterns 259.

Figure 7:
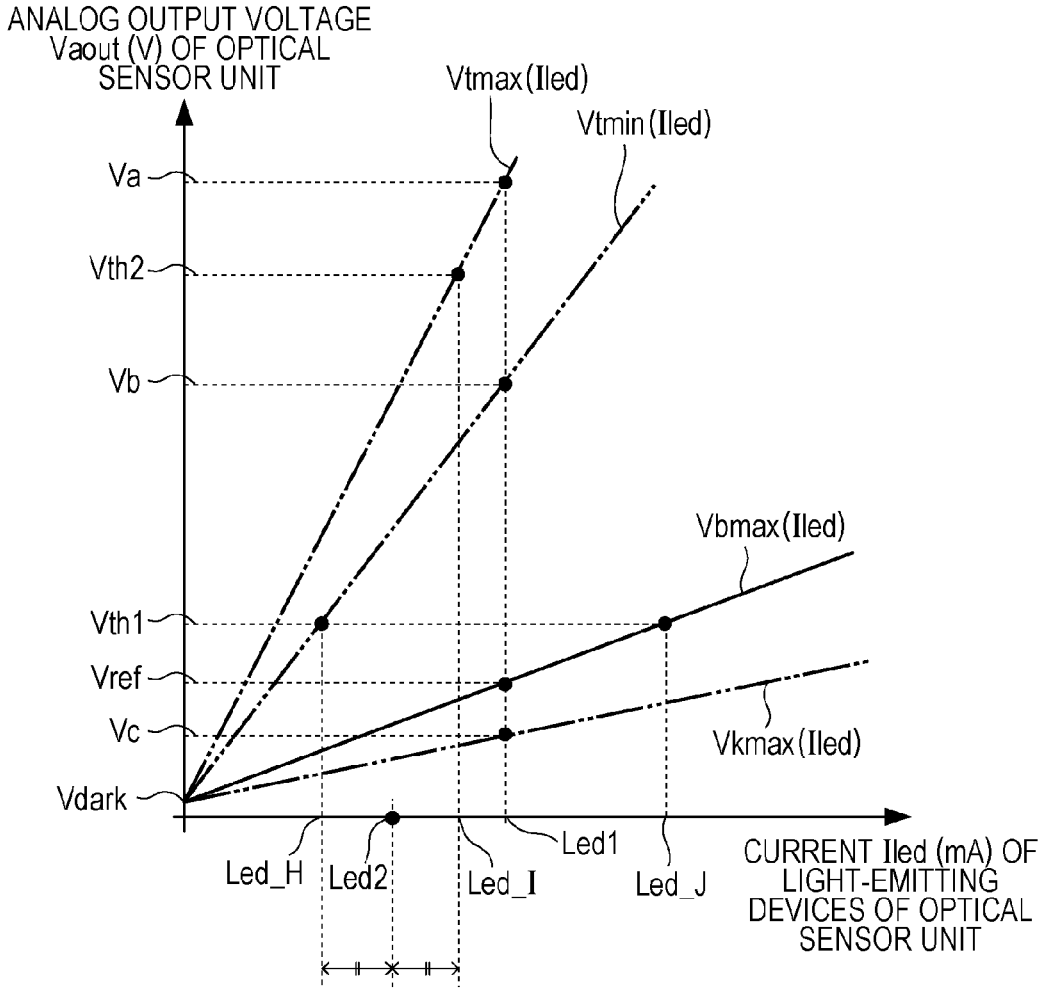
FIG. 7 is a graph illustrating output characteristics of diffuse reflection light against the amount of light used for calculating the amount of light emitted according to the first embodiment.

Amount of Light Emitted by Light-Emitting Devices of Optical Sensor Unit and Expression for Calculating Optimal Amount of Light FIG. 7 is a graph used for calculating the amount of light emitted by the light-emitting devices 253 and 256 of the optical sensor 225 (hereinafter also referred to simply as the "amount of light emitted by the sensor"). More specifically, FIG. 7 is a graph illustrating characteristics of the analog output voltage Vaout (V) against the duty ratio of the driving signal Vledon at a time when the optical sensor 225 detects a toner pattern or the surface of the intermediate transfer belt 219. A horizontal axis represents the current Iled (mA) according to the duty ratio of the driving signal Vledon illustrated in FIG. 2B. If currents I flowing into the light-emitting devices 253 and 256 increase, the amount of light L emitted by the light-emitting devices 253 and 256 also increases. In the following description, the amount of light L might therefore be used as a term having the same meaning as the current I. A vertical axis represents the analog output voltage Vaout (V). As described with reference to FIG. 2B, as the duty ratio of the driving signal Vledon increases, the currents flowing into the light-emitting devices 253 and 256 increase, thereby increasing the amount of light emitted. The analog output voltages Vaout, which are obtained as a result of photoelectric conversion, generated by the light-receiving devices 254, 255, and 257 of the optical sensor 225 increase accordingly.

A voltage Vdark is a dark voltage of each of the light-receiving devices 254 and 257, which are diffuse-reflection-light receiving devices. The dark voltage Vdark is a voltage generated when the power supply voltage Vcc is applied in the driving circuits and dark currents of the light-receiving devices 254 and 257 flow into the resistors 301 and is a certain value while the light-receiving devices 254 and 257 are not receiving light. A procedure for calculating the amount of light emitted by the sensor with which the above-described misregistration detection toner patterns 258 and density variation detection toner patterns 259 can both be appropriately detected will be described.

A first amount of light Led1, which is indicated on the horizontal axis illustrated in FIG. 7, is a predetermined amount of light emitted by the sensor and stored in a read-only memory (ROM), which is not illustrated, or the like in advance. First, the light-emitting device 253 of the optical sensor 225 emits light by the certain amount of light Led1, and the analog output voltage Vaout for the surface of the intermediate transfer belt 219 is detected. The analog output voltage output from the optical sensor 225 at this time, that is, a result of the detection performed on the intermediate transfer belt 219, will be referred to as a first voltage Vref. Here, a diffuse reflectance ratio R1, which is a first ratio, is a ratio of the diffuse reflectance of a toner pattern whose output is the highest among detected voltages of the chromatic toner patterns, namely the yellow, magenta, and cyan toner patterns, to the diffuse reflectance of the surface of the intermediate transfer belt 219. A diffuse reflectance ratio R2, which is a second ratio, is a ratio of the diffuse reflectance of a toner pattern whose output is the lowest among the detected voltages of the chromatic toner patterns, namely the yellow, magenta, and cyan toner patterns, to the diffuse reflectance of the surface of the intermediate transfer belt 219. Furthermore, a diffuse reflectance ratio R3, which is a third ratio, is a ratio of a maximum output voltage at a time when the black toner pattern is detected to the diffuse reflectance of the surface of the intermediate transfer belt 219.

The diffuse reflectance ratios R1, R2, and R3 are values predetermined in consideration of variation during transfer of each toner pattern, variation in diffuse reflection on the surface of the intermediate transfer belt 219, variation in control of the optical sensor 225, and the like. Voltages Va, Vb, and Vc are calculated based on the predetermined diffuse reflectance ratios R1, R2, and R3 between the intermediate transfer belt 219 and the toner patterns and the voltages Vref and Vdark. The voltage Va is an estimated analog output voltage of the toner pattern whose output is the highest when the light-emitting devices 253 and 256 emit light by the amount of light Led1 and the yellow, magenta, and cyan toner patterns are detected. The voltage Vb is an estimated analog output voltage of the toner pattern whose output is the lowest when the light-emitting devices 253 and 256 emit light by the amount of light Led1 and the yellow, magenta, and cyan toner patterns are detected. The voltage Vc is an estimated maximum output voltage at a time when the black toner pattern is detected. Expressions for calculating the voltage Va, which is a second voltage, the voltage Vb, which is a third voltage, and the voltage Vc, which is a fourth voltage, are the following expressions 7-1 to 7-3.

$$Va=(V\text{ref}-V\text{dark})\times R1+V\text{dark} \tag{7-1}$$

$$Vb=(V\text{ref}-V\text{dark})\times R2+V\text{dark} \tag{7-2}$$

$$Vc=(V\text{ref}-V\text{dark})\times R3+V\text{dark} \tag{7-3}$$

The voltages Va, Vb, and Vc calculated from the above expressions 7-1 to 7-3 are estimated output voltages at a time when the light-emitting devices 253 and 256 emit light by the amount of light Led1. In the graph of FIG. 7, dash-dot-dot lines connecting the calculated voltages Va, Vb, and Vb and the dark voltage Vdark, which is a voltage while no light is being emitted (the amount of light emitted is zero), indicate characteristics of the analog output voltage for the detection targets against the amount of light emitted. That is, when the yellow, magenta, and cyan toner patterns are detected, characteristics of the analog output voltage for the toner pattern whose output is the highest against the amount of light emitted is denoted by Vtmax(Iled). When the yellow, magenta, and cyan toner patterns are detected, characteristics of the analog output voltage for the toner pattern whose output is the lowest against the amount of light emitted is denoted by Vtmin(Iled). Characteristics of the maximum analog output voltage against the amount of light emitted when the black toner pattern is detected are denoted by Vkmax(Iled). The characteristics of the maximum analog output voltage for the surface of the intermediate transfer belt 219 against the amount of light emitted is indicated by a solid line Vbmax(Iled) through an intersection between the amount of light Led1 and the voltage Vref obtained by actually detecting the surface of the intermediate transfer belt 219.

Now, three values of the amount of light emitted corresponding to voltages on the output characteristics (the dash-dot-dot lines illustrated in FIG. 7) for the detection targets defined as above are calculated. A first value is the amount light emitted Led_I, at which Vtmax(Led_I)=Vth2. A second value is the amount of light Led_J, at which Vbmax(Led_J)=Vth1. A third value is the amount of light Led_H, at which Vtmin(Led_H)=Vth1. The calculated values Led_I, Led_J, and Led_H of the amount of light emitted are represented by the following expressions 7-4 to 7-6 based on the output characteristics corresponding to these values of the amount of light emitted by the sensor. A value Ledth is the amount of light corresponding to the dark voltage Vdark, that is, Ledth=0.

$$\text{Led_}H=(\text{Led1}-\text{Led}th)\times(Vth1-V\text{dark})/(Vb-V\text{dark}) \quad (7\text{-}4)$$

$$\text{Led_}I=(\text{Led1}-\text{Led}th)\times(Vth2-V\text{dark})/(Va-V\text{dark}) \quad (7\text{-}5)$$

$$\text{Led_}J=(\text{Led1}-\text{Led}th)\times(Vth1-V\text{dark})/(V\text{ref}-V\text{dark}) \quad (7\text{-}6)$$

In order to successfully detect the amount of misregistration between the toner patterns and the amount of variation in density, an optimal amount of light Led2, which is a second amount of light emitted by the sensor, is set within a range defined by the following condition 7-7 based on the conditions 6-1 to 6-3.

$$\text{Led_}H<\text{Led2}<\text{MIN}(\text{Led_}I,\text{Led_}J) \quad (7\text{-}7)$$

In this condition, "MIN(Led_I, Led_J)" means that Led_I or Led_J, whichever is the smaller, is selected. Since Led_I<Led_J in FIG. 7, a value that satisfies Led_H<Led2<Led_I is set as Led2.

As illustrated in FIG. 7, the optimal amount of light Led2 can be a midpoint between Led_H and Led_I or Led_J, whichever is the smaller, in order to leave a margin around the threshold voltage Vth1. By using the optimal amount of light Led2, a potential difference between the voltage Vtmin and the threshold voltage Vth1 and a potential difference between the threshold voltage Vth1 and the voltage Vbmax can be secured. Even if noise is generated, the voltages Vtmin and Vbmax do not exceed the threshold voltages Vth1 and Vth2, thereby making it possible to detect the amount of misregistration and the amount of variation in density accurately without reducing an SN ratio.

In the present embodiment, more specifically, the amount of light Led1 is 20 mA, the dark voltage Vdark is 0.3 V, the voltage Vref is 0.7 V, the threshold voltage Vth1 is 1.2 V, the threshold voltage Vth2 is 3.2 V, and the value Ledth is 0 V. The diffuse reflectance ratio R1 is 9.0625, the diffuse reflectance ratio R2 is 5.625, and the diffuse reflectance ratio R3 is 0.5. From the above expressions 7-1 to 7-3, the voltage Va=3.925 V, the voltage Vb=2.55 V, and the voltage Vc=0.5 V are obtained. From the above expressions 7-4 to 7-6, the amount of light Led_H=8.0 mA, the amount of light Led_I=16.0 mA, and the amount of light Led_J=45 mA are obtained. From the above condition 7-7, the optimal amount of light Led2 emitted by the sensor for accurately detecting the amount of misregistration between the toner patterns and the amount of variation in density needs to be 8.0 mA<Led2<16.0 mA. In the present embodiment, in the condition 7-7, the amount of light Led_I, which is smaller than Led_J, is used. The optimal amount of light Led2 is thus determined as (16.0 mA+8.0 mA)/2=12.0 mA, which is a midpoint, in order to leave a margin around the threshold voltage Vth1.

Figure 8:
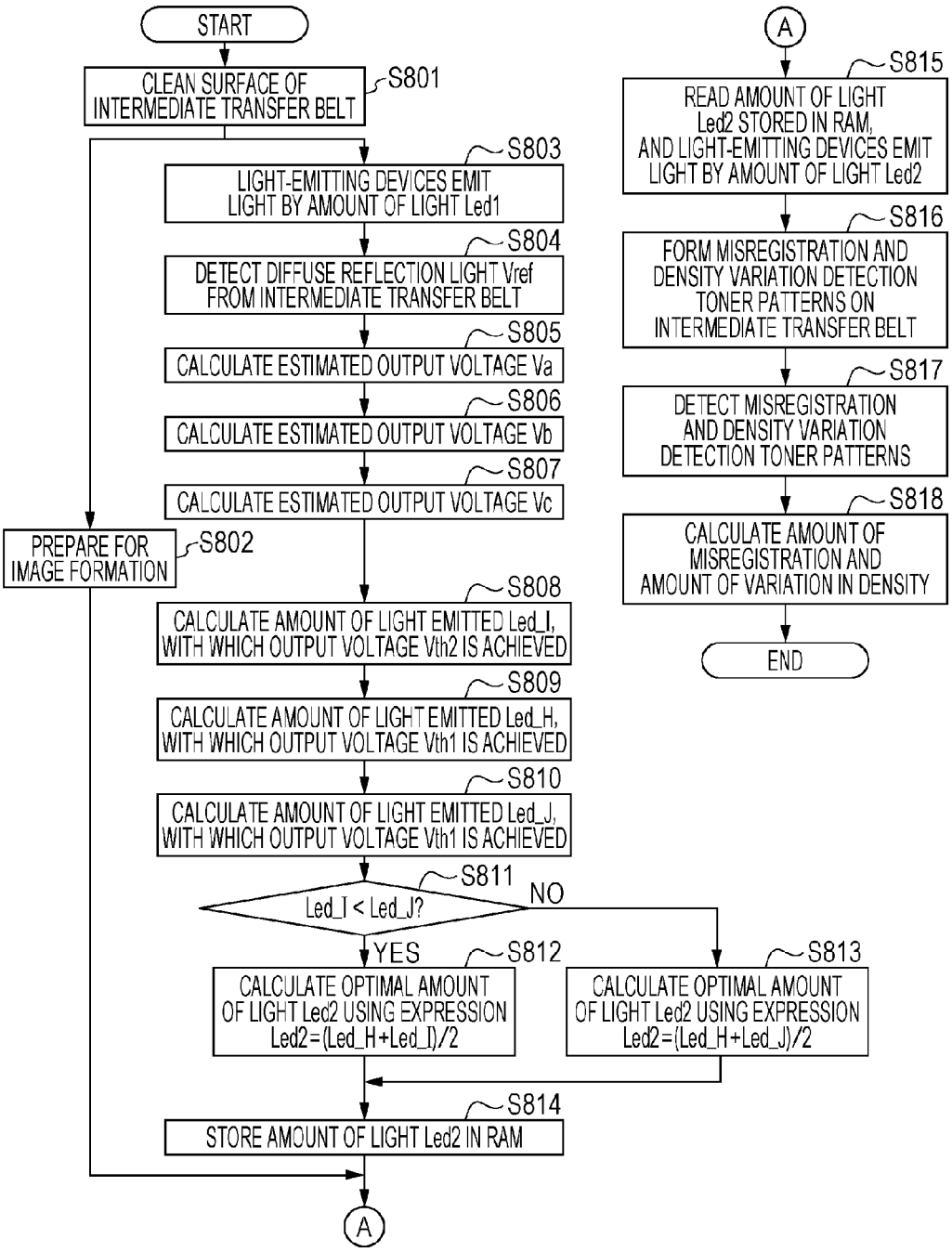
FIG. 8 is a flowchart illustrating a process for calculating the amount of misregistration and the amount of variation in density according to the first embodiment.

Sequence for Calculating Amount of Light Emitted by Light-Emitting Devices of Optical Sensor Unit FIG. 8 is a flowchart illustrating an operation sequence according to the present embodiment performed by the CPU 209 until the optical sensor 225 detects the correction patterns and calculates the amount of misregistration and the amount of variation in density after calculating the amount of light emitted. If the CPU 209 receives, from the controller 204, an instruction to begin misregistration correction control and density correction control (hereinafter referred to as "misregistration correction and density correction control"), the CPU 209 begins the following process. In step (hereinafter denoted by "S") 801, the CPU 209 begins the misregistration correction and density correction control. The CPU 209 causes the cleaning device 228 to clean the surface of the intermediate transfer belt 219 and complete the cleaning. In S802, the CPU 209 causes actuators, the scanner unit 210, and the like to prepare for an operation for forming the misregistration detection toner patterns 258 and the density variation detection toner patterns 259. The processing in S802 and processing in S803 to S814, which will be described later, are executed in parallel with each other, and accordingly the flowchart of FIG. 8 has two paths.

The processing in S803 to S814 is executed in parallel with the processing in S802. In S803, the CPU 209 sets the duty ratios of the driving signals Vledon output from the I/O-PWM ports 524 and 529 such that the amount of light emitted by the light-emitting devices 253 and 256 becomes Led1 and causes the light-emitting devices 253 and 256 to emit light. Currents that enable the light-emitting devices 253 and 256 to emit light by the amount of light Led1 flow into the light-emitting devices 253 and 256. In S804, the CPU 209 detects diffuse reflection light from the surface of the intermediate transfer belt 219 using the light-receiving devices 254 and 257 while keeping the amount of light emitted by the light-emitting devices 253 and 256 at Led1. Meanwhile, the optical sensor 225 outputs the analog output voltage Vref to the CPU 209.

In S805, the CPU 209 calculates, from the expression 7-1, the estimated output voltage Va of the optical sensor 225 at a time when the light-emitting devices 253 and 256 emit light by the amount of light Led1, using the voltage Vref detected in S804, the diffuse reflectance ratio R1, and the dark current Vdark. In S806, the CPU 209 calculates, from the expression 7-2, the estimated output voltage Vb of the optical sensor 225 at a time when the light-emitting devices 253 and 256 emit light by the amount of light Led1, using the voltage Vref detected in S804 detected in S804 and the diffuse reflectance ratio R2. In S807, the CPU 209 calculates, from the expression 7-3, the estimated output voltage Vc of the optical sensor 225 at a time when the light-emitting devices 253 and 256 emit light by the amount of light Led1, using the voltage Vref detected in S804 and the diffuse reflectance ratio R3.

In S808, the CPU 209 calculates, from the expression 7-5, the amount of light Led_I, at which the analog output voltage of the optical sensor 225 (hereinafter also referred to simply as a "sensor output") becomes the threshold voltage Vth2, using the estimated output voltage Va calculated in S805. In S809, the CPU 209 calculates, from the expression 7-4, the amount of light Led_H, at which the sensor output becomes the threshold voltage Vth1, using the estimated output voltage Vb calculated in S806. In S810, the CPU 209 calculates, from the expression 7-6, the amount of light Led_J, at which the sensor output becomes the threshold voltage Vth1, using the voltage Vref detected in S804.

In S811, the CPU 209 compares the amount of light Led_I calculated in S808 and the amount of light Led_J calculated in S810 with each other and determines whether the amount of light Led_I is smaller than the amount of light Led_J. If the CPU 209 determines in S811 that the amount of light Led_I is smaller than the amount of light Led_J (Led_I<Led_J), the process proceeds to S812. In S812, in order to leave margins around the threshold voltages Vth1 and Vth2, the CPU 209 calculates a midpoint between the amount of light Led_H and the amount of light Led_I ((Led_H+Led_I)/2) as the optimal amount of light Led2. On the other hand, if the CPU 209 determines in S811 that the amount of light Led_I is equal to or larger than the amount of light Led_J (Led_I Led_J), the process proceeds to S813. In S813, in order to leave margins around the threshold voltages Vth1 and Vth2, the CPU 209 calculates a midpoint between the amount of light Led_H and the amount of light Led_J ((Led_H+Led_J)/2) as the optimal amount of light Led2. In S814, the CPU 209 stores the optimal amount of light Led2 calculated in S812 or S813 in the RAM 280.

After the parallel processing in S802 and S803 to S814 is completed, the CPU 209 reads, in S815, the amount of light Led2 stored in the RAM 280 and causes the light-emitting devices 253 and 256 to emit light by the amount of light Led2. In S816, the CPU 209 forms the misregistration detection toner patterns 258 and the density variation detection toner patterns 259 on the intermediate transfer belt 219. In S817, the CPU 209 detects, using the optical sensor 225, the correction patterns formed on the intermediate transfer belt 219 and detects the analog output voltages Vaout and the digital output voltages Vdout, which are obtained as a result of conversion into the voltages performed by the above-described driving circuits. In S818, the CPU 209 calculates the amount of misregistration and the amount of variation in density based on a timing at which the voltages have been detected in S817 and the analog output voltage Vaout. The CPU 209 then calculates the amount of correction based on the amount of misregistration and the amount of variation in density and ends the process.

In the present embodiment, the amount of light is calculated during the preparation for image formation, but the amount of light can be calculated in a short period of time. For example, therefore the amount of light can be calculated whenever the surface of the intermediate transfer belt 219 can be detected, such as immediately after the image forming apparatus is turned on or after the completion of the image formation. In addition, in the present embodiment, the correction patterns are formed on the intermediate transfer belt 219 and detected immediately after the optimal amount of light Led2 is calculated and saved to the RAM 280. The correction patterns can be detected using the optimal amount of light Led2, however, even some time after the amount of light Led2 is saved to the RAM 280.

Timing Chart Relating to Optical Sensor

Figure 9:
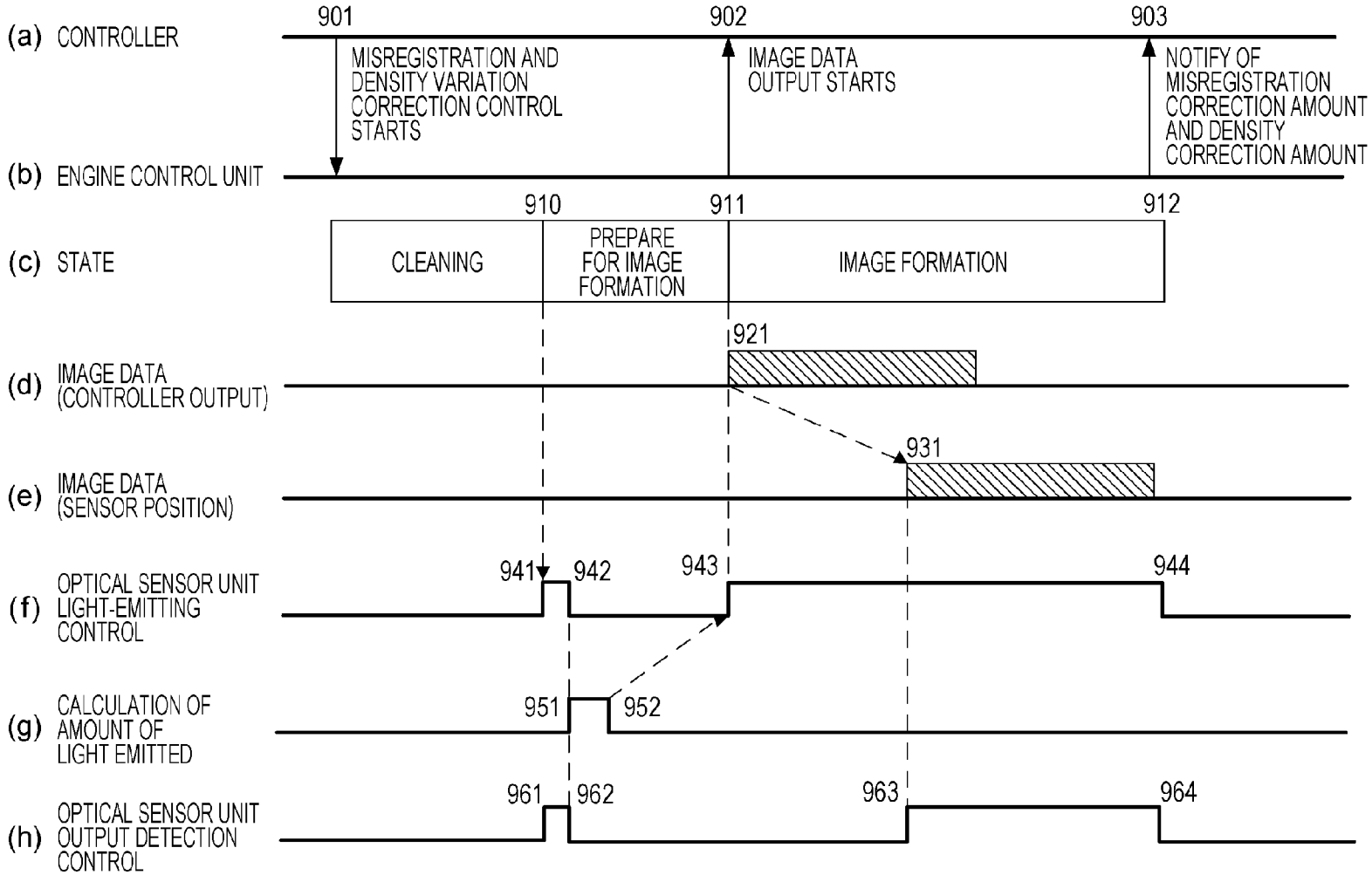
FIG. 9 is a timing chart illustrating misregistration and density variation correction control according to the first embodiment.

FIG. 9 is a timing chart illustrating a process according to the present embodiment. In FIG. 9, reference numerals 901 to 964 denote timings. Parts (a) and (b) of FIG. 9 illustrate transmission and reception of signals between the controller 204 and the engine control unit 206. A part (c) of FIG. 9 illustrates states of the printer 201. A part (d) of FIG. 9 illustrates image data output from the controller 204, and a part (e) of FIG. 9 illustrates a timing at which the correction patterns, which are the image data, formed on the intermediate transfer belt 219 reach the optical sensor 225. A part (f) of FIG. 9 illustrates light emission control for the light-emitting devices 253 and 256 of the optical sensor 225. A part (g) of FIG. 9 illustrates a timing at which the CPU 209 calculates the amount of light emitted by the light-emitting devices 253 and 256. A part (h) of FIG. 9 illustrates timings at which the optical sensor 225 outputs detected voltages to the CPU 209. Horizontal axes represent time.

If the engine control unit 206 receives a misregistration and density variation correction control start signal from the controller 204 at a timing 901, the cleaning device 228 cleans the intermediate transfer belt 219. The timing 901 corresponds to a timing (hereinafter simply referred to as "processing") at which the processing in S801 illustrated in FIG. 8 begins. After the cleaning performed by the cleaning device 228 is completed at a timing 910, the CPU 209 prepares for image formation. The timing 910 corresponds to the processing in S802 illustrated in FIG. 8. After the cleaning is completed, at a timing 941, the CPU 209 causes the light-emitting devices 253 and 256 of the optical sensor 225 to emit light by the amount of light Led1. The timing 941 corresponds to the processing in S803 illustrated in FIG. 8. At a timing 961, the CPU 209 detects diffuse reflection light from the surface of the intermediate transfer belt 219 using the light-receiving devices 254 and 257. The timing 961 corresponds to the processing in S804 illustrated in FIG. 8.

After detecting the diffuse reflection light from the surface of the intermediate transfer belt 219 at the timing 962 using the light-receiving devices 254 and 257, the CPU 209 turns off the light-emitting devices 253 and 256 at a timing 942. At a timing 951, the CPU 209 calculates the optimal amount of light Led2 in accordance with the above-described procedure and, at a timing 952, saves the optimal amount of light Led2, which is a result of the calculation, to the RAM 280. The timings 951 and 952 correspond to the processing in S805 to S814 illustrated in FIG. 8. After calculating the optimal amount of light Led2, saving the amount of light Led2 to the RAM 280, and, at a timing 911, completing the preparation for image formation, the CPU 209 instructs the controller 204 to begin to output image data.

After receiving an image data output start signal at a timing 902, the controller 204 outputs image data to the engine control unit 206. At a timing 921, the CPU 209 receives the image data and forms the correction patterns. At a timing 943, the CPU 209 reads the optimal amount of light Led2 from the RAM 280 and adjusts the amount of light emitted by the light-emitting devices 253 and 256 to the optimal amount of light Led2. The timing 943 corresponds to the processing in S815 illustrated in FIG. 8, and the timing 921 corresponds to the processing in S816 illustrated in FIG. 8. At a timing 931, the correction patterns on the intermediate transfer belt 219 reach a position at which the optical sensor 225 reads the correction patterns. At a timing 963, the CPU 209 begins to detect (read) the correction patterns using the optical sensor 225. The timing 963 corresponds to the processing in S817 illustrated in FIG. 8.

At a timing 912, the image formation is completed. After stopping detecting the correction patterns at a timing 964, the CPU 209 causes, at a timing 944, the light-emitting devices 253 and 256 to stop emitting light. At a timing 903, the CPU 209 calculates the amount of correction of misregistration and the amount of correction of density and notifies the controller 204 of the amount of correction of misregistration and the amount of correction of density. The timing 903 corresponds to the processing in S818 illustrated in FIG. 8.

Figures 10A, 10B:
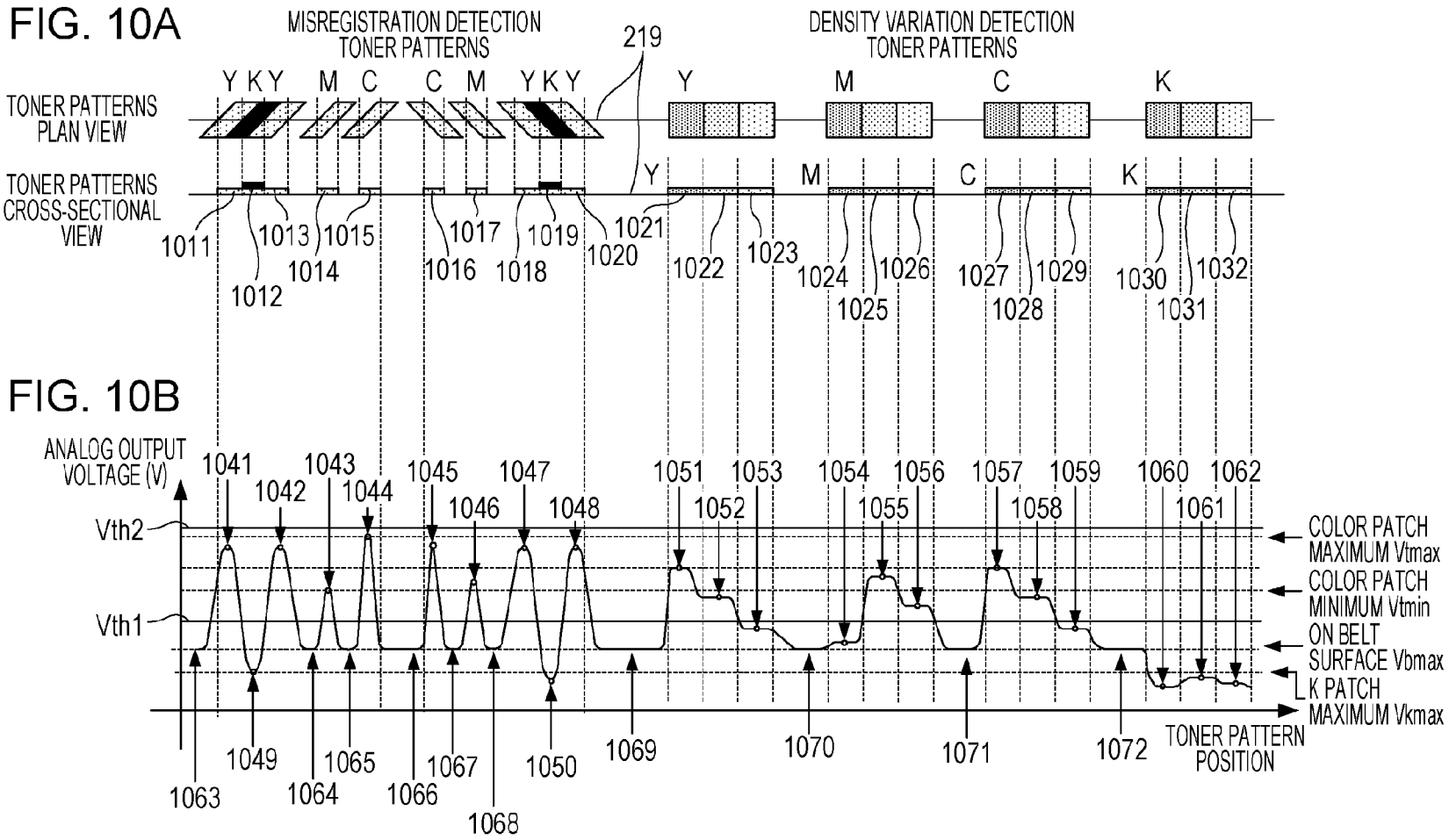
FIGS. 10A and 10B are diagrams illustrating a waveform of an analog output voltage according to the first embodiment at a time when the correction patterns are detected.

Toner Patterns after Optimal Amount of Light is Set and Waveform of Analog Output Voltage FIGS. 10A and 10B are diagrams illustrating a waveform of the analog output voltage Vaout output from the optical sensor 225 when the optical sensor 225 detects the misregistration detection toner patterns 258 and the density variation detection toner patterns 259 according to the present embodiment. FIG. 10A includes a plan view and a cross-sectional view of the correction patterns, and FIG. 10B illustrates the waveform of the analog output voltage Vaout output when the optical sensor 225 reads the correction patterns illustrated in FIG. 10A. Horizontal axes represent positions of the toner patterns. The misregistration detection toner patterns 258 include yellow, magenta, cyan, and black toner patterns 1011 to 1020 transferred onto the intermediate transfer belt 219. As indicated by the toner patterns 1012 and 1019, the black toner patterns are superimposed upon the yellow toner patterns. The density variation detection toner patterns 259 include toner patterns 1021 to 1032. The yellow, magenta, cyan, and black toner patterns each include three tones whose densities are different from one another.

The analog output voltage Vaout of the optical sensor 225 reaches points 1041, 1042, 1047, and 1048 when the optical sensor 225 detects the yellow toner patterns of the misregistration detection toner patterns 258. The analog output voltage Vaout of the optical sensor 225 reaches points 1051 to 1053 when the optical sensor 225 detects the different tones of the yellow toner pattern of the density variation detection toner patterns 259. The analog output voltage Vaout of the optical sensor 225 reaches points 1043, 1046, and 1054 to 1056 when the optical sensor 225 detects the magenta toner patterns of the correction patterns. The analog output voltage Vaout of the optical sensor 225 reaches points 1044, 1045, and 1057 to 1059 when the optical sensor 225 detects the cyan toner patterns of the correction patterns. The analog output voltage Vaout of the optical sensor 225 reaches points 1049, 1050, and 1060 to 1062 when the optical sensor 225 detects the black toner patterns of the correction patterns. The analog output voltage Vaout of the optical sensor 225 reaches points 1063 to 1072 when the optical sensor 225 detects portions of the surface of the intermediate transfer belt 219.

The CPU 209 causes the light-emitting devices 253 and 256 to emit light by the optimal amount of light Led2 calculated thereby and sequentially detects the correction patterns. A maximum output voltage Vtmax when the optical sensor 225 detects the yellow, magenta, and cyan toner patterns of the density variation detection toner patterns 259 has a certain potential difference from the threshold voltage Vth2. In FIGS. 10A and 10B, the maximum output voltage Vtmax when the optical sensor 225 detects the yellow, magenta, and cyan toner patterns is indicated as "color patch maximum". A minimum output voltage ("color patch minimum") Vtmin when the optical sensor 225 detects the yellow, magenta, and cyan toner patterns of the misregistration detection toner patterns 258 has a certain potential difference from the threshold voltage Vth1.

The maximum output voltage Vkmax when the optical sensor 225 detects the black toner patterns and the maximum output voltage Vbmax when the optical sensor 225 detects the surface of the intermediate transfer belt 219 have certain potential differences from the threshold voltage Vth1. In FIG. 10B, the maximum output voltage Vkmax is indicated as "K patch maximum", and the maximum output voltage Vbmax is indicated as "on belt surface". That is, if the CPU 209 causes the light-emitting devices 253 and 256 to emit light by the optimal amount of light Led2 in the present embodiment and the correction patterns are detected, the above-described Conditions 1-3 (expressions 6-1 to 6-4) are satisfied. Therefore, even if the waveform of the analog output voltage Vaout deforms due to noise or the like, output differences (potential differences) from the thresholds can be secured without reducing the SN ratio, thereby making it possible to detect the amount of misregistration and the amount of variation in density appropriately.

As described above, the optical sensor 225 detects diffuse reflection light from the surface of the intermediate transfer belt 219 without any toner pattern transferred onto the intermediate transfer belt 219, and the CPU 209 calculates the optimal amount of light Led2 from the predetermined diffuse reflectance ratios R1 to R3 between the intermediate transfer belt 219 and the toner patterns. In the present embodiment, since the optimal amount of light Led2 can thus be calculated in a short period of time without using toner patterns, a waiting time of a user can be reduced. In addition, by detecting the toner patterns using the calculated optimal amount of light Led2, certain potential differences from the threshold voltages Vth1 and Vth2 can be secured, which makes it possible to detect the correction patterns reliably and accurately even if the output waveform is affected by noise. According to the present embodiment, the waiting time of the user can be reduced while accurately detecting the amount of misregistration and the amount of variation in density.

Second Embodiment

In the first embodiment, a configuration has been described in which the optimal amount of light emitted is calculated when the diffuse reflectance of the surface of the intermediate transfer belt 219 is higher than that of the achromatic toner pattern but lower than those of the chromatic toner patterns. More specifically, the amount of diffuse reflection light received from the surface of the intermediate transfer belt 219 is detected, and the amount of light when the amount of misregistration and the amount of variation in density are detected is set based on the detected output voltage and the predetermined diffuse reflectance ratios between the intermediate transfer belt 219 and the correction patterns. In a second embodiment, in the configuration in which the diffuse reflectance of the surface of the intermediate transfer belt 219 is higher than that of the achromatic toner pattern but lower than those of the chromatic toner patterns, a method for calculating the optimal amount of light emitted when differences between the diffuse reflectance of the intermediate transfer belt 219 and those of the chromatic toner patterns are small will be described. In the calculation of the amount of light emitted according to the present embodiment, the correction patterns transferred onto the intermediate transfer belt 219 are detected using the amount of light Led2 calculated in the first embodiment, and the optimal amount of light emitted is updated based on the results of the detection. A basic configuration in the present embodiment is the same as that in the first embodiment. The same components as those illustrated in FIGS. 1A to 3B are therefore given the same reference numerals as those illustrated in FIGS. 1A to 3B, and description thereof is omitted.

Characteristic Graph for Calculating Amount of Light

Figure 11:
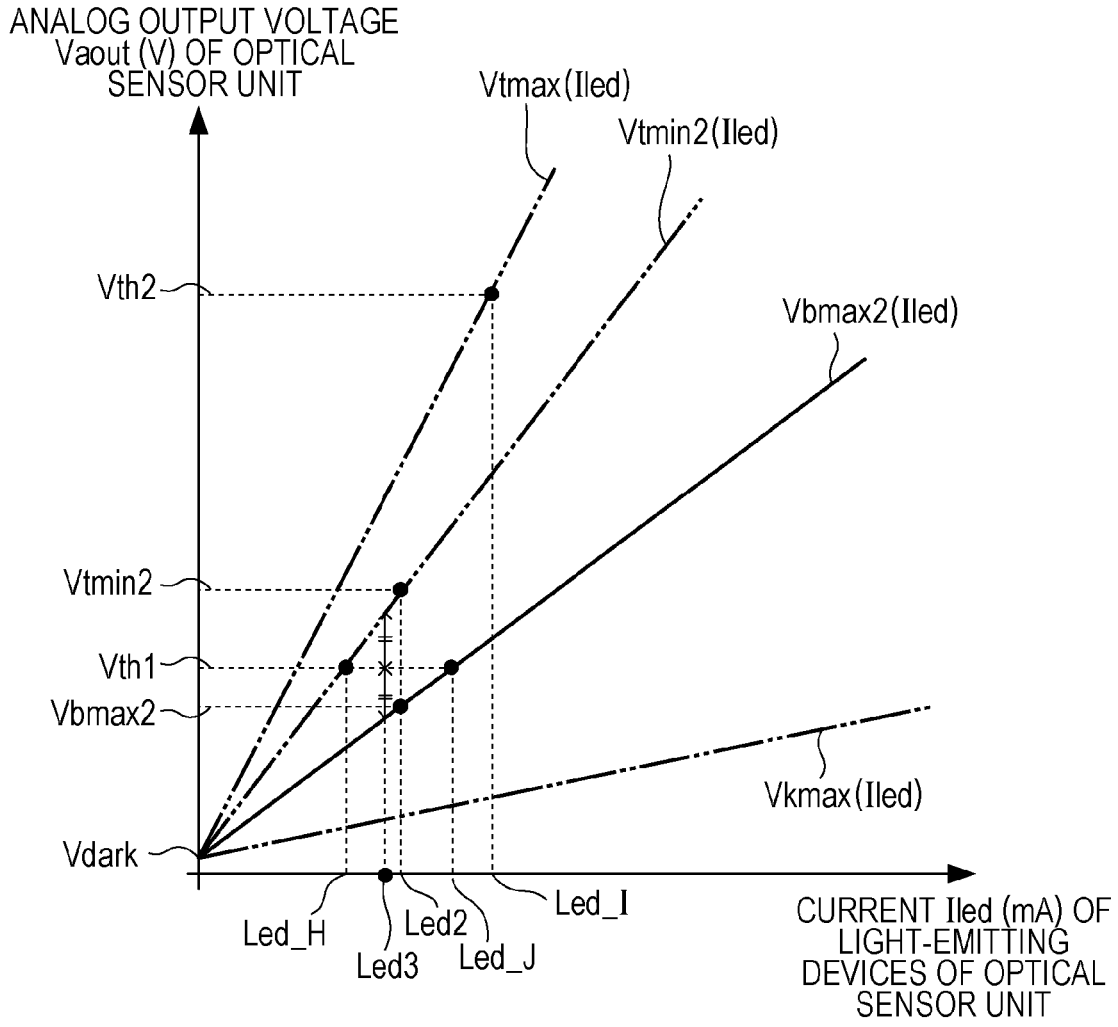
FIG. 11 is a graph illustrating output characteristics of diffuse reflection light against the amount of light used for calculating the amount of light emitted according to the second embodiment.

FIG. 11 is a diagram illustrating characteristics, which indicate the method for calculating the amount of light emitted according to the present embodiment, of the analog output voltage of the optical sensor 225 against the amount of light emitted by the light-emitting devices 253 and 256. A horizontal axis and a vertical axis are the same as those illustrated in FIG. 7, and accordingly description thereof is omitted. A process performed until the CPU 209 causes the light-emitting devices 253 and 256 of the optical sensor 225 to emit light by the optimal amount of light Led2 and the optical sensor 225 detects the correction patterns is the same as the processing in S803 to S812 or S813 according to the first embodiment illustrated in FIG. 8. A minimum output voltage Vtmin2, which is a lowest voltage among voltages obtained when the CPU 209 causes the light-emitting devices 253 and 256 to emit light by the amount of light Led2 and the optical sensor 225 detects the plurality of chromatic toner patterns, is represented by the following expression 11-1.

$$Vt\text{min}2=\text{Led}2\times(Vth1-V\text{dark})/\text{Led_}H+V\text{dark} \quad (11\text{-}1)$$

A maximum output voltage Vbmax2, which is a highest voltage among voltages obtained when the optical sensor 225 detects the surface of the intermediate transfer belt 219, is represented by the following expression 11-2.

$$Vb\text{max}2=\text{Led}2\times(Vth1-V\text{dark})/\text{Led_}J+V\text{dark} \quad (11\text{-}2)$$

A line connecting the voltage Vtmin2 at a time when the CPU 209 causes the light-emitting devices 253 and 256 to emit light by the amount of light Led2 and the dark voltage Vdark, which is a voltage while no light is being emitted, is denoted by Vtmin2(Iled). While no light is being emitted, the amount of light emitted is zero. More specifically, the line Vtmin2(Iled) indicates characteristics of the analog output voltage Vaout for a chromatic toner pattern against the amount of light emitted by the light-emitting devices 253 and 256 of the optical sensor 225. A line connecting the maximum output voltage Vbmax2 for the surface of the intermediate transfer belt 219 at a time when the CPU 209 causes the light-emitting devices 253 and 256 to emit light by the amount of light Led2 and the dark voltage Vdark, which is a voltage while no light is being emitted, will be referred to as an "output voltage characteristic Vbmax2 (Iled)" for the surface of the intermediate transfer belt 219.

Based on the above characteristics, the amount of light Led3 is calculated, with which an output difference between the minimum output voltage Vtmin2 when the chromatic toner patterns are detected and the threshold voltage Vth1 and an output difference between the threshold voltage Vth1 and the maximum output voltage Vbmax2 for the surface of the intermediate transfer belt 219 become the same. The amount of light Led3, which is a third amount of light, is represented by the following expression 11-3.

$$\text{Led}3=2\times(Vth1-V\text{dark})\times\text{Led}2/(Vt\text{min}2+Vb\text{max}2-2\times V\text{dark}) \quad (11\text{-}3)$$

The CPU 209 stores the calculated amount of light Led3 in the RAM 280 and detects the amount of misregistration and the amount of variation in density. A potential difference between a voltage that is a result of the detection of the toner patterns and the threshold voltage Vth1 and a potential difference between the threshold voltage Vth1 and a voltage that is a result of the detection of the surface of the intermediate transfer belt 219 thus become the same. As a result, even if an output waveform detected by the optical sensor 225 is affected by noise, the amount of misregistration and the amount of variation in density can be accurately detected since the threshold is set using stable portions of the output waveform.

In the present embodiment, the threshold voltage Vth1=1.2 V, the amount of light Led2 described in the first embodiment is 12 mA, Led_I=16 mA, Led_H=8 mA, and the dark voltage Vdark=0.3 V. The voltage Vtmin2, which is obtained by detecting the correction patterns formed on the intermediate transfer belt 219 using the optical sensor 225 that emits light by the amount of light Led2, is 1.65 V. The voltage Vbmax2, which is obtained by detecting the surface of the intermediate transfer belt 219 using the optical sensor 225 that emits light by the amount of light Led2, is 0.975 V. The optimal amount of light Led3, which is calculated from the output obtained by radiating light onto the correction patterns formed on the intermediate transfer belt 219 by the amount of light Led2, is, from the expression 11-3, 10.67 mA. When the amount of light Led3 is 10.67 mA, the voltage Vtmin is 1.5 V and the voltage Vbmax is 0.9 V. Thus, the threshold voltage Vth1, which is 1.2 V, is a midpoint value between the voltage Vtmin and the voltage Vbmax.

Figure 12:
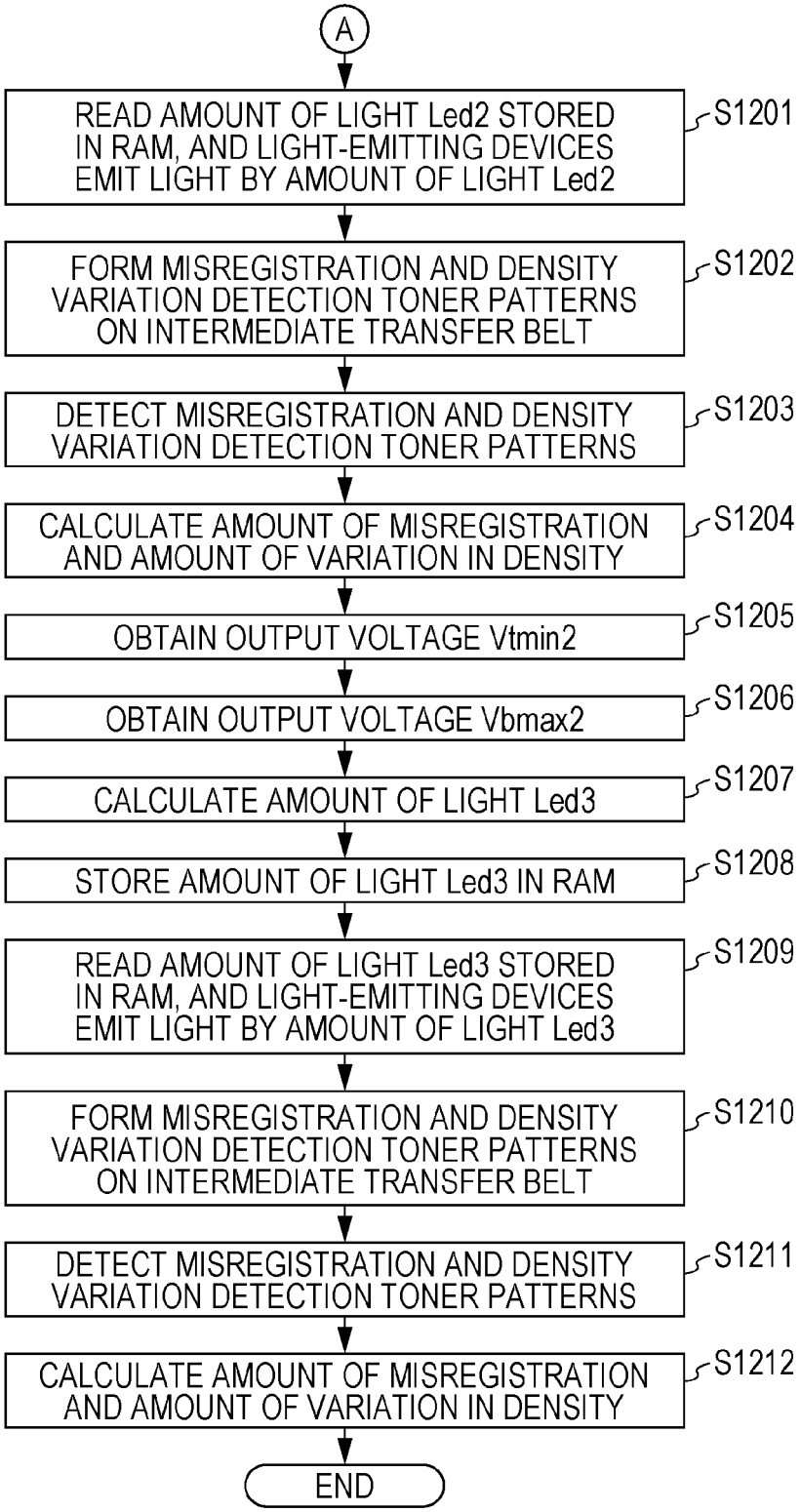
FIG. 12 is a flowchart illustrating a process for calculating the amount of misregistration and the amount of variation in density according to the second embodiment.

Sequence for Calculating Amount of Light Emitted by Light-Emitting Devices of Optical Sensor FIG. 12 is a flowchart illustrating a process according to the present embodiment performed until the amount of light is calculated and the amount of misregistration and the amount of variation in density are detected. The parallel processing in S801 and S802 to S814 according to the first embodiment illustrated in FIG. 8 is also performed in the second embodiment, and description thereof is omitted. FIG. 12 illustrates only processing after "A" illustrated in FIG. 8 as processing in S1201 and later steps. In S1201, the CPU 209 reads the amount of light Led2 stored in the RAM 280 in S814 and causes the light-emitting devices 253 and 256 to emit light by the amount of light Led2. In S1202, the CPU 209 forms the correction patterns on the intermediate transfer belt 219. In S1203, the CPU 209 detects the correction patterns formed on the intermediate transfer belt 219 using the optical sensor 225. In S1204, the CPU 209 calculates the amount of misregistration and the amount of variation in density based on the results of the detection performed by the optical sensor 225 using the amount of light Led2. The processing in S1204 need not necessarily be performed.

In S1205, the CPU 209 obtains the minimum output voltage Vtmin2 among results of the detection performed on the chromatic toner patterns based on the basis results of the detection performed in S1203 on the correction patterns. In S1206, the CPU 209 obtains the maximum output voltage Vbmax2 among the results of the detection performed on the intermediate transfer belt 219 based on the results of the detection performed on the surface of the intermediate transfer belt 219. In S1207, the CPU 209 calculates the amount of light Led3 from the expression 11-3 using the minimum output voltage Vtmin2 obtained in S1205 and the maximum output voltage Vbmax2 obtained in S1206. In S1208, the CPU 209 stores the amount of light Led3 calculated in S1207 in the RAM 280. The processing in S1209 to S1212 is the same as the processing in S815 to S818 illustrated in FIG. 8 except that the CPU 209 causes the light-emitting devices 253 and 256 to emit light by the amount of light Led3, and accordingly description thereof is omitted.

Figures 13A, 13B:
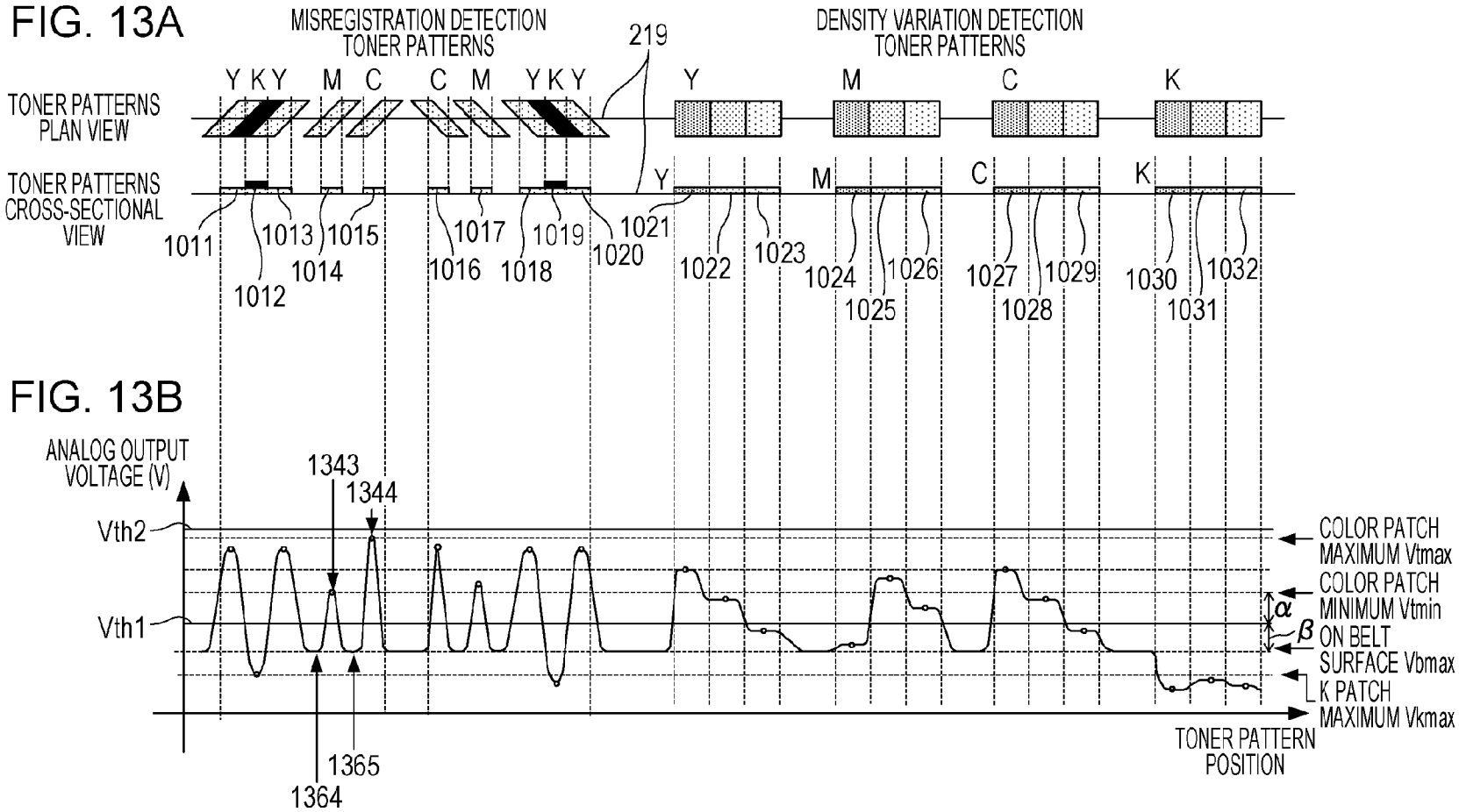
FIGS. 13A and 13B are diagrams illustrating a waveform of the analog output voltage according to the second embodiment at a time when the correction patterns are detected.

Toner Patterns after Optimal Amount of Light is Set and Analog Output Waveform of Optical Sensor FIGS. 13A and 13B illustrate a waveform of the analog output voltage Vaout at a time when the CPU 209 causes the optical sensor 225 to emit light by the amount of light Led3 and the optical sensor 225 detects the correction patterns. FIG. 13A is the same as FIG. 10A, and accordingly description thereof is omitted. FIG. 13B corresponds to FIG. 10B, and accordingly description of elements described with reference to FIG. 10B is omitted.

The output value Vtmin is a minimum value (1343) of the analog output voltage at a time when the chromatic toner patterns of the misregistration detection toner pattern 258 are detected. The output value Vbmax is a maximum value (1364 and 1365) of the analog output voltage at a time when the surface of the intermediate transfer belt 219 is detected. The CPU 209 causes the optical sensor 225 to emit light by the amount of light Led3 calculated by the above-described calculation method and detect the correction patterns. In the present embodiment, the output waveform of the analog output voltage Vaout when the optical sensor 225 detects each of the correction patterns is as follows. That is, a potential difference $\alpha$ between the minimum value Vtmin of the analog output voltage Vaout and the threshold voltage Vth1 and a potential difference $\beta$ between the threshold voltage Vth1 and the maximum value Vbmax of the analog output voltage Vaout when the surface of the intermediate transfer belt 219 is detected become the same ($\alpha=\beta$). In the present embodiment, too, the maximum value Vtmax (1344) of the analog output voltage Vaout is smaller than the threshold voltage Vth2.

Therefore, even if the waveform of the analog output voltage is affected by noise, the potential difference between the minimum value of the analog output voltage when the toner patterns are detected and the potential difference between the threshold voltage and the maximum value of the analog output voltage when the surface of the intermediate transfer belt 219 is detected become the same. Thus, in the present embodiment, stable portions of the waveform exceed the threshold voltage Vth1. The stable portions of the waveform of the analog output voltage are binarized, and the amount of misregistration is detected with the analog output voltage being lower than or equal to the threshold voltage Vth2. As a result, the amount of misregistration and the amount of variation in density can be accurately detected.

As described above, the optical sensor 225 detects diffuse reflection light from the surface of the intermediate transfer belt 219 without any toner pattern transferred onto the intermediate transfer belt 219. The CPU 209 calculates the amount of light Led2 from a detected output of the diffuse reflection light and the predetermined diffuse reflectance ratios between the surface of the intermediate transfer belt 219 and the toner patterns. Furthermore, the optical sensor 225 detects the toner patterns using the amount of light Led2. The CPU 209 then calculates the amount of light Led3, with which the potential difference between the minimum value of the analog output voltage at this time and the threshold voltage Vth1 and the potential difference between the threshold voltage Vth1 and the maximum value of the analog output voltage when the surface of the intermediate transfer belt 219 is detected become the same. The CPU 209 causes the light-emitting devices 253 and 256 of the optical sensor 225 to emit light by the calculated amount of light Led3 and detects the correction patterns using the optical sensor 225.

In the present embodiment, since the optimal amount of light can be calculated before the correction patterns are formed on the intermediate transfer belt 219, the waiting time of the user can be reduced. In addition, even in the present embodiment, in which the diffuse reflectance of the surface of the intermediate transfer belt 219 is high and therefore an output difference from diffuse reflection light from the chromatic toner patterns is small, the following configuration is used. That is, the optimal amount of light Led3 is further calculated based on the results of the detection already performed on the toner patterns and the results of the detection performed on the surface of the intermediate transfer belt 219. By updating the amount of light emitted by the light-emitting devices 253 and 256 to the calculated amount of light Led3, the threshold voltage Vth1 is set using stable portions of the waveform of the analog output voltage. As a result, the amount of misregistration and the amount of variation in density can be detected reliably and accurately. Thus, according to the present embodiment, the waiting time of the user can be reduced while accurately detecting the amount of misregistration and the amount of variation in density.

Third Embodiment

In a third embodiment, description of the same elements as those according to the first embodiment is omitted. In the first embodiment, the optimal amount of light Led2 is calculated based on the detected voltage of diffuse reflection light from the surface of the intermediate transfer belt 219 and the predetermined diffuse reflectance ratios R1 to R3 between the toner patterns and the surface of the intermediate transfer belt 219. The CPU 209 then controls optical sensor 225 in such a way as to achieve the calculated amount of light Led2. In the present embodiment, not the amount of light emitted by the light-emitting devices 253 and 256 of the optical sensor 225 but the threshold voltage Vth1 is changed. A method for optimizing, in this manner, output differences between the threshold voltage Vth1 and an output that is a result of the detection performed on the misregistration detection toner pattern 258 and between the threshold voltage Vth1 and an output that is a result of the detection performed on the surface of the intermediate transfer belt 219 will be described.

Control Circuit

Figure 14A:
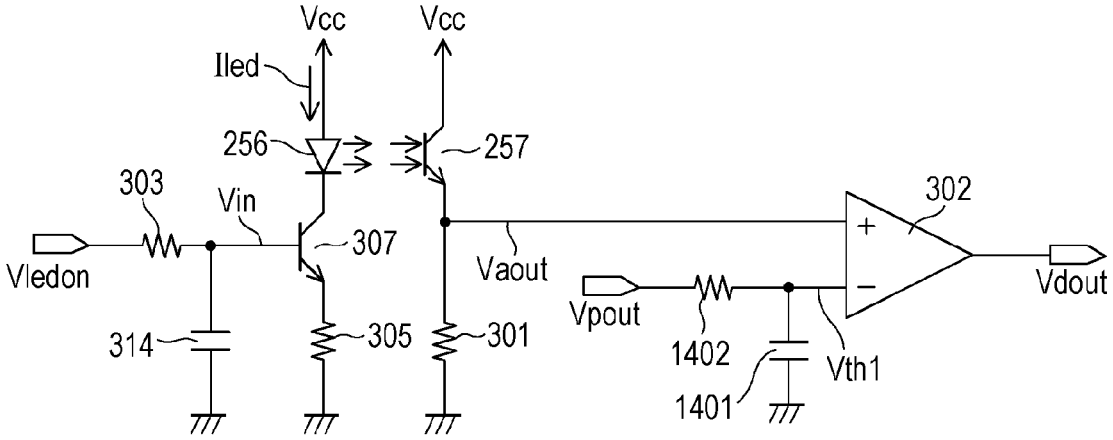
FIG. 14A is a diagram illustrating a driving circuit for the optical sensor according to the third embodiment.

FIG. 14A is a diagram illustrating a driving circuit for the optical sensor 225 according to the present embodiment. The same components as those illustrated in FIG. 2A are given the same reference numerals, and accordingly description thereof is omitted. Unlike the configuration illustrated in FIG. 2A, a resistor 1402, a capacitor 1401, and a signal Vpout output from the CPU 209 are connected to the negative input terminal of the comparator 302, in order to output the threshold voltage Vth1. The signal Vpout is, as with the driving signal Vledon, a rectangular wave signal whose on-duty ratio can be changed. The CPU 209 can change the threshold voltage Vth1 smoothed by the resistor 1402 and the capacitor 1401 by changing the on-duty ratio of the signal Vpout.

Characteristic Graph for Calculating Amount of Light

Figure 14B:
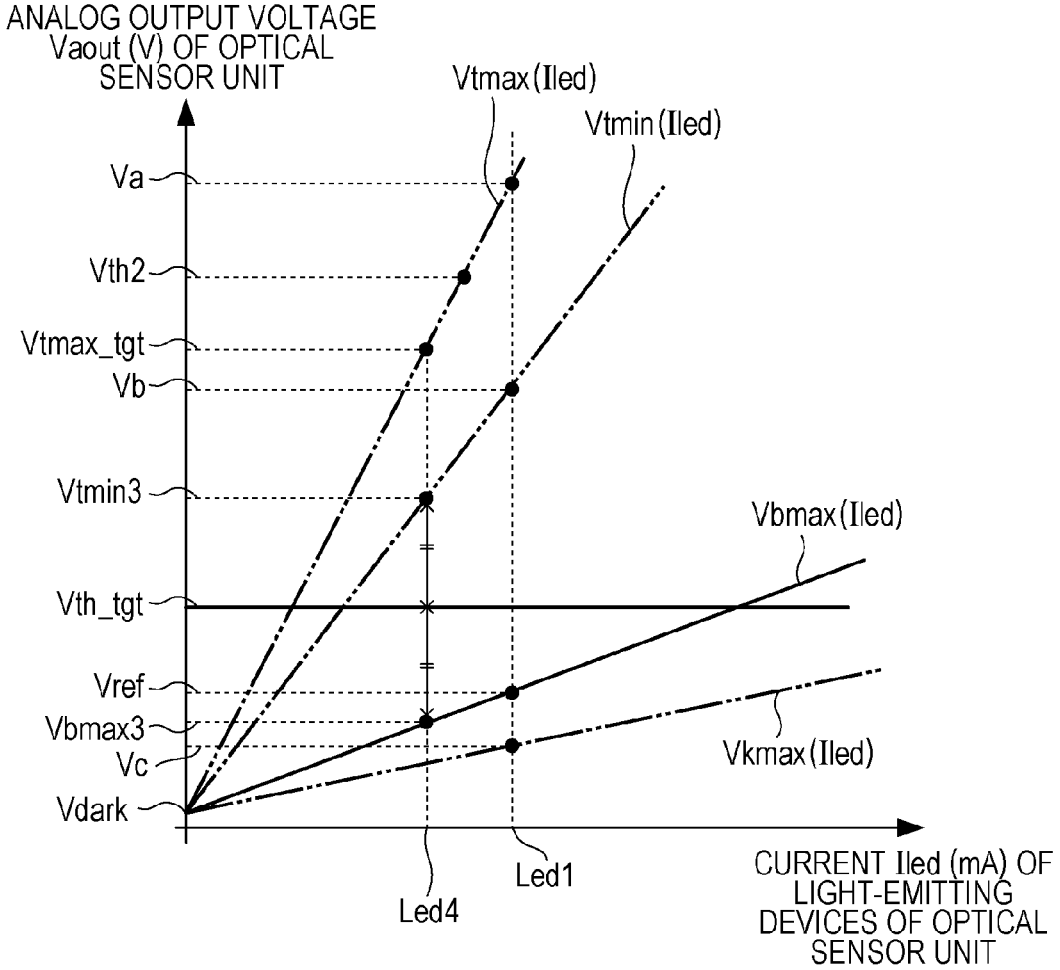
FIG. 14B is a graph illustrating output characteristics of diffuse reflection light against the amount of light used for calculating the amount of light emitted.

FIG. 14B is a graph illustrating characteristics, which are used for calculating the optimal threshold voltage Vth1, of the analog output voltage of the optical sensor 225 against the amount of light emitted by the light-emitting devices 253 and 256 according to the present embodiment. A horizontal axis and a vertical axis are the same as those illustrated in FIG. 7, and accordingly description thereof is omitted. Because a procedure for calculating the characteristics Vtmax(Iled), Vtmin(Iled), and Vkmax(Iled) of the analog output voltage Vaout against the amount of light emitted is the same as that according to the first embodiment, and accordingly description thereof is omitted.

A voltage Vtmax_tgt is a predetermined target value that is a maximum sensor output voltage on the line Vtmax(Iled) at a time when the correction patterns are detected. The voltage Vtmax_tgt is, for example, stored in the ROM, which is not illustrated. Here, the amount of light Led4, which is a second amount of light, with which the voltage Vtmax_tgt is achieved, is calculated. The amount of light Led4 is represented by the following expression 15-1.

$$\text{Led4}=(V\text{tmax_}tgt-V\text{dark})\times\text{Led1}/(Va-V\text{dark}) \quad (15\text{-}1)$$

Next, an output voltage Vtmin3, which corresponds to the amount of light Led4 on the line Vtmin(Iled), is calculated. The voltage Vtmin3 is represented by the following expression 15-2.

$$V\text{tmin3}=\text{Led4}\times(Vb-V\text{dark})/\text{Led1}+V\text{dark} \quad (15\text{-}2)$$

In addition, an output voltage Vbmax3, which corresponds to the amount of light Led4 on the line Vbmax(Iled), is calculated. The voltage Vbmax3 is represented by the following expression 15-3.

$$V\text{bmax3}=\text{Led4}\times(V\text{ref}-V\text{dark})/\text{Led1}+V\text{dark} \quad (15\text{-}3)$$

An optimal threshold Vth_tgt, which is a midpoint value between the voltage Vtmin3 calculated using the expression 15-2 and the voltage Vbmax3 calculated using the expression 15-3, is represented by the following expression 15-4.

$$Vth_tgt=\{(V\text{tmin3}-V\text{dark})+(V\text{bmax3}-V\text{dark})\}/2+V\text{dark}=(V\text{tmin3}+V\text{bmax3})/2 \quad (15\text{-}4)$$

More specifically, in the present embodiment, the amount of light Led1 is 20 mA, the dark voltage Vdark is 0.3 V, and the voltage Vref is 0.7 V as in the first embodiment. The diffuse reflectance ratio R1 is 9.0625, the diffuse reflectance ratio R2 is 5.625, and the diffuse reflectance ratio R3 is 0.5. Va=3.925 V, Vb=2.55 V, and Vc=0.5 V. Vtmax_tgt is 2.8 V. From the above expressions 15-1, 15-2, and 15-3, the amount of light Led4=13.8 mA, the voltage Vtmin3=1.8525 V, and the voltage Vbmax3=0.576. From the expression 15-4, the optimal threshold Vth_tgt is 1.214 V. The resistor 1402 has a resistance of 1.8 kΩ, and the capacitor 1401 has a capacitance of 0.1 μF. The signal Vpout is a rectangular wave that outputs 0 to 3.3 V, and the frequency thereof is 156 kHz. A setting value Vp2 of the on-duty ratio of the signal Vpout, at which the optimal threshold Vth_tgt becomes 1.214 V, is 60%.

Sequence for Calculating Optimal Threshold

Figure 15:
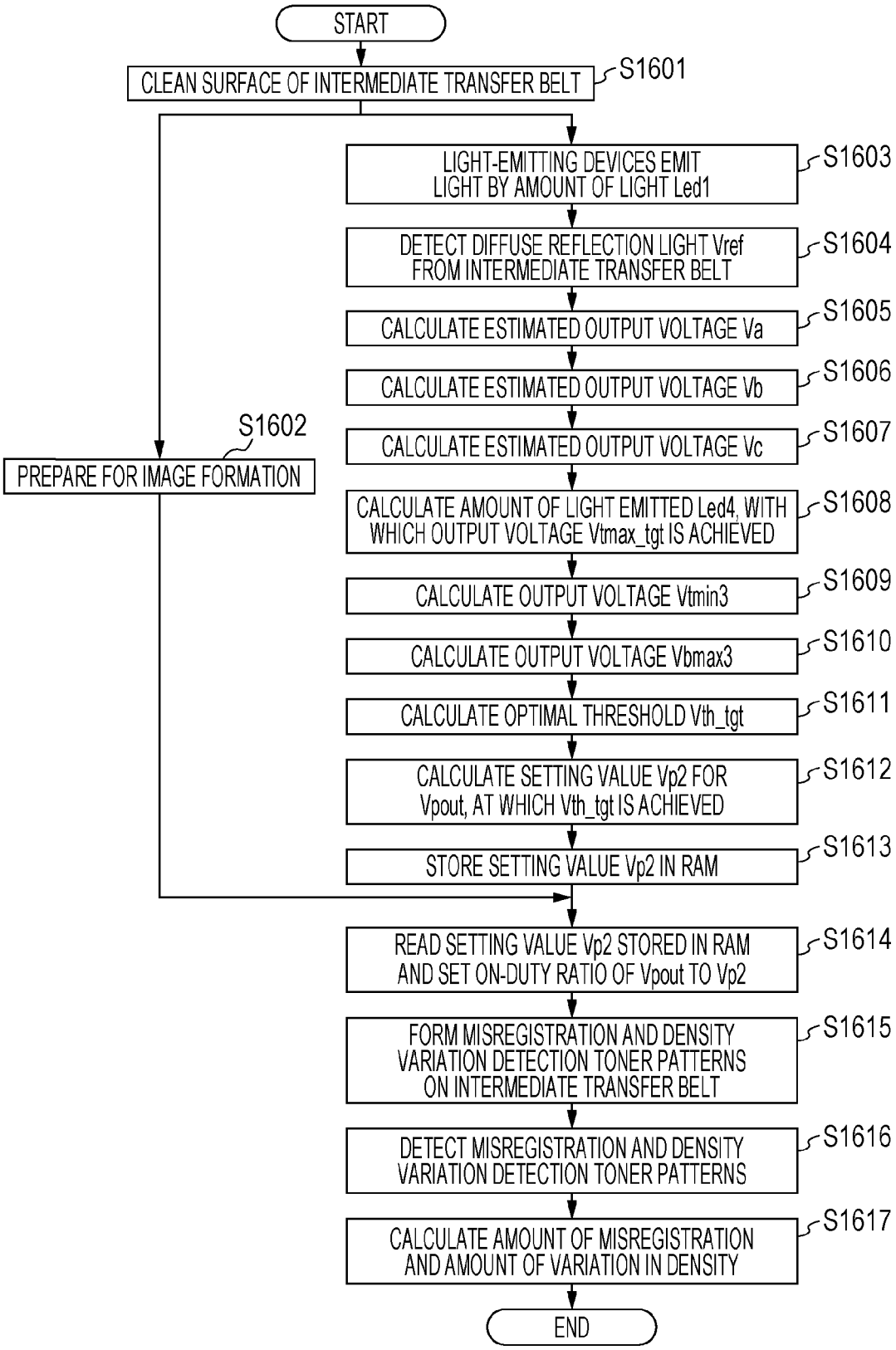
FIG. 15 is a flowchart illustrating a process for calculating the amount of misregistration and the amount of variation in density according to the third embodiment.

FIG. 15 is a flowchart illustrating a process according to the present embodiment performed until the optimal threshold Vth_tgt (=Vth1) is calculated. Processing in S1601 to S1607 is the same as the processing in S801 to S807 according to the first embodiment illustrated in FIG. 8, and accordingly description thereof is omitted. In S1608, the CPU 209 calculates, from the expression 15-1, the amount of light Led4, with which the predetermined value Vtmax_tgt is achieved, using the voltage Va calculated in S1605. In S1609, the CPU 209 calculates, from the expression 15-2, the voltage Vtmin3 using the voltage Vb calculated in S1606 and the amount of light Led4 calculated in S1608. In S1610, the CPU 209 calculates, from the expression 15-3, the voltage Vbmax3 using the voltage Vref detected in S1604 and the amount of light Led4 calculated in S1608.

In S1611, the CPU 209 calculates, from the expression 15-4, the optimal threshold Vth_tgt using the output voltage Vtmin3 calculated in S1609 and the output voltage Vbmax3 calculated in S1610. In S1612, the CPU 209 calculates the setting value Vp2 of the on-duty ratio of the signal Vpout, at which the optimal threshold Vth_tgt calculated in S1611 is achieved. In S1613, the CPU 209 saves the calculated setting value Vp2 of the on-duty ratio to the RAM 280.

In S1614, the CPU 209 reads the setting value Vp2 of the on-duty ratio stored in the RAM 280 and sets the on-duty ratio of the signal Vpout to Vp2. Processing in S1615 to S1617 is the same as the processing in S816 to S818 according to the first embodiment illustrated in FIG. 8, and accordingly description thereof is omitted. However, the amount of light emitted by the light-emitting devices 253 and 256 when the correction patterns are detected in S1616 is Led4. In the present embodiment, the optimal threshold is calculated in parallel with the preparation for image formation, but the optimal threshold can be calculated in a short period of time. For example, the optimal threshold can be calculated whenever the surface of the intermediate transfer belt 219 can be detected, such as immediately after the image forming apparatus is turned on or after the completion of the image formation.

Figures 16A, 16B:
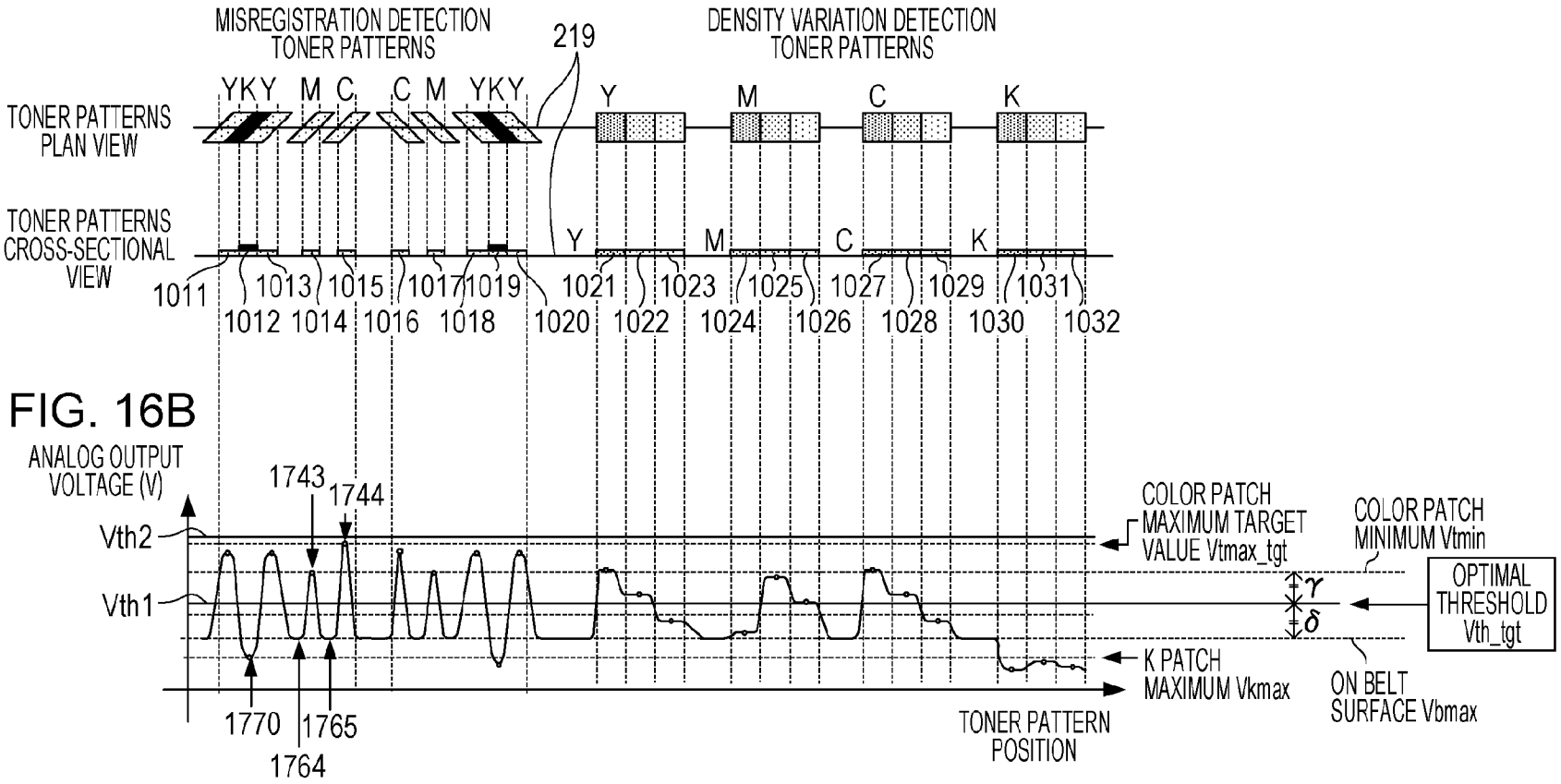
FIGS. 16A and 16B are diagrams illustrating a waveform of the analog output voltage according to the third embodiment at a time when the correction patterns are detected.

Toner Patterns after Optimal Threshold is Set and Waveform of Analog Output Voltage FIGS. 16A and 16B illustrate a waveform of the analog output voltage of the optical sensor 225 according to the present embodiment at a time when the amount of misregistration and the amount of variation in density are detected. FIG. 16A is the same as FIG. 10A, and accordingly description thereof is omitted. FIG. 16B corresponds to FIG. 10B, and accordingly description of elements described with reference to FIG. 10B is omitted. A voltage Vtmin is an analog output voltage (1743) of a toner pattern whose output voltage is the lowest at a time when the optical sensor 225 detects the plurality of chromatic toner patterns. A voltage Vbmax is a maximum value (1764 and 1765) of the analog output voltage at a time when the optical sensor 225 detects the surface of the intermediate transfer belt 219. A voltage Vkmax is a maximum value (1770) of the analog output voltage at a time when the optical sensor 225 detects the black toner patterns. A voltage Vtmax_tgt is an analog voltage (1744) of a toner pattern whose output is the highest when the optical sensor 225 detects the plurality of chromatic toner patterns.

As described above, the optimal threshold Vth_tgt is calculated such that the threshold voltage Vth1 becomes a midpoint between the minimum value Vtmin of the detected voltage of the chromatic toner patterns and the maximum value Vbmax of the detected voltage of the surface of the intermediate transfer belt 219. The signal Vpout output from the CPU 209 is set in such a way as to achieve the optimal threshold Vth_tgt. By setting the threshold voltage Vth1 to the optimal threshold Vth_tgt, even the analog output voltage for the intermediate transfer belt 219 whose diffuse reflectance is high can exceed the threshold Vth_tgt in stable portions of the waveform thereof output from the optical sensor 225. That is, a potential difference between the minimum output voltage Vtmin when the toner patterns are detected and the optimal threshold Vth_tgt and a potential difference between the optimal threshold Vth_tgt and the maximum output voltage Vbmax when the intermediate transfer belt 219 is detected become the same. In other words, if the potential difference between the minimum output voltage Vtmin when the toner patterns are detected and the optimal threshold Vth_tgt is denoted by γ and the potential difference between the optimal threshold Vth_tgt and the maximum output voltage Vbmax when the intermediate transfer belt 219 is detected is denoted by δ, γ and δ become the same. Therefore, even if the waveform of the analog output voltage Vaout is affected by noise or the like, the SN ratio between the optimal threshold Vth_tgt and the minimum output voltage Vtmin when the toner patterns are detected or the maximum output voltage Vbmax when the surface of the intermediate transfer belt 219 is detected can be maintained. As a result, the amount of misregistration can be reliably and accurately detected.

As described above, the optical sensor 225 detects diffuse reflection light from the surface of the intermediate transfer belt 219 without any toner pattern transferred onto the intermediate transfer belt 219. Since the CPU 209 can calculate the optimal amount of light from a detected output of the diffuse reflection light and the predetermined diffuse reflectance ratios between the surface of the intermediate transfer belt 219 and the toner patterns, time taken to complete the calculation of the amount of light can be reduced. In addition, when the correction patterns are detected by causing the light-emitting devices 253 and 256 to emit light by the amount of light Led4, the threshold voltage Vth1 is set to a midpoint between the minimum voltage Vtmin at a time when the chromatic toner patterns are detected and the maximum voltage Vbmax at a time when the surface of the intermediate transfer belt 219 is detected. That is, the threshold voltage Vth1 is set to the optimal threshold Vth_tgt. Therefore, the output differences between the output voltage when the surface of the intermediate transfer belt 219 is detected and the optimal threshold Vth_tgt and between the output voltage when the chromatic toner patterns are detected and the optimal threshold Vth_tgt can be maintained, thereby maintaining the SN ratio even if the waveform is affected by noise. As a result, the amount of misregistration can be reliably and accurately detected. As described above, according to the present embodiment, the waiting time of the user can be reduced while accurately detecting the amount of misregistration and the amount of variation in density.

According to the present disclosure, the waiting time of the user can be reduced while accurately detecting the amount of misregistration and the amount of variation in density.

While the present disclosure has been described with reference to exemplary embodiments, it is to be understood that these exemplary embodiments are not seen to be limiting. The scope of the following claims is to be accorded the broadest interpretation so as to encompass all such modifications and equivalent structures and functions.

This application claims the benefit of Japanese Patent Application No. 2014-122445, filed Jun. 13, 2014, which is hereby incorporated by reference herein in its entirety.

What is claimed is:

1. An image forming apparatus comprising:

a rotary member configured to bear a toner image or a recording material;

an image forming unit configured to form a detection pattern on the rotary member, the detection pattern being a toner image for detecting an amount of misregistration or an amount of variation in density;

a detection unit including a light-emitting device that emits light onto the rotary member or the detection pattern and a light-receiving device that receives light reflected from the rotary member or the detection pattern and outputs a corresponding voltage; and a control unit configured to:

control the light-emitting device to emit a first amount of light;

control the light-receiving device to receive an amount of light reflected from the rotary member and output a first voltage;

acquire a first estimated amount of light based on a prediction coefficient for the rotary member and the first voltage;

acquire a second estimated amount of light based on a prediction coefficient for the detection pattern and the first voltage;

acquire a second amount of light based on the first estimated amount of light and the second estimated amount of light; and perform misregistration correction or density correction, based on a detection result which is detected by the detection unit such that the light-emitting device emits light having the second amount of light onto the detection pattern.

2. The image forming apparatus according to claim 1, wherein the detection pattern includes a first pattern and a second pattern, the first pattern including toner images of a plurality of colors including black and non-black colors and the second pattern including toner images including different tones for each of the plurality of colors.

3. The image forming apparatus according to claim 2, wherein the first pattern includes a toner image formed by superimposing a black toner image upon a toner image of at least one of the non-black colors.

4. The image forming apparatus according to claim 2, wherein, a first threshold voltage is lower than a voltage detected when the detection unit detects the toner image of at least one of the non-black colors included in the first pattern, is higher than a voltage detected when the detection unit detects the black toner image included in the first pattern, is higher than a voltage detected when the detection unit detects the rotary member, and is lower than a second threshold voltage, which is set when the detection unit detects the second pattern.

5. The image forming apparatus according to claim 2, wherein a first predetermined ratio is a ratio of a reflectance of a toner image of the non-black color for which an output of the light-receiving device is largest to a reflectance of the rotary member, a second predetermined ratio is a ratio of a reflectance of a toner image of the non-black color for which the output of the light-receiving device is smallest to the reflectance of the rotary member, and a third predetermined ratio, is a ratio of a reflectance of the black toner image to the reflectance of the rotary member.

6. The image forming apparatus according to claim 5, wherein, the control unit estimates, based on the first voltage and the first predetermined ratio, a second voltage, at which an output of the light-receiving device when the light-receiving device receives light reflected from the toner images of the non-black colors becomes largest, wherein, the control unit estimates, based on the first voltage and the second predetermined ratio, a third voltage, at which the output of the light-receiving device when the light-receiving device receives the light reflected from the toner images of the non-black colors becomes smallest, wherein, the control unit estimates, based on the first voltage and the third predetermined ratio, a fourth voltage, which is output from the light-receiving device when the light-receiving device receives light reflected from the black toner image.

7. The image forming apparatus according to claim 6, wherein the control unit determines a first threshold such that a voltage output from the light-receiving device when the light-emitting device emits the second amount of light becomes greater than the first threshold when the detection unit detects the toner images of the non-black colors included in the first pattern and less than the first threshold when the detection unit detects the rotary member.

8. The image forming apparatus according to claim 2, wherein the control unit updates, to a third amount of light, an amount of light which is emitted by the light-emitting device when the detection unit detects the detection pattern based on voltages output from the light-receiving device when the light-emitting device emits the second amount of light and the light-receiving device receives reflection light from the first pattern and the rotary member.

9. The image forming apparatus according to claim 2, wherein the first pattern is a pattern for detecting the amount of misregistration, and wherein the light-receiving device receives irregular reflection light from the first pattern and outputs a digital voltage value.

10. The image forming apparatus according to claim 2, wherein the second pattern is a pattern for detecting the amount of variation in density, and wherein the light-receiving device receives regular reflection light from the second pattern and outputs an analog voltage value.

11. The image forming apparatus according to claim 1, wherein the light-emitting device is a laser diode and the light-receiving device is a phototransistor.

12. An image forming apparatus comprising:

a rotary member configured to bear a toner image or a recording material;

an image forming unit configured to form a detection pattern on the rotary member, the detection pattern being a toner image for detecting an amount of misregistration or an amount of variation in density;

a detection unit including a light-emitting device that emits light onto the rotary member or the detection pattern and a light-receiving device that receives light reflected from the rotary member or the detection pattern and outputs a corresponding voltage; and a control unit configured to:

control the light-emitting device to emit a first amount of light;

control the light-receiving device to receive an amount of light reflected from the rotary member and output a first voltage;

acquire a first estimated voltage based on a prediction coefficient for the rotary member and the first voltage, the first estimated voltage being a voltage estimated in a case where the light-emitting device emits light of which amount is different from the first amount of light, and corresponding to the light reflected from the rotary member;

acquire a second estimated voltage based on a prediction coefficient for the detection pattern and the first voltage, the second estimated voltage being a voltage estimated in a case where the light-emitting device emits light of which amount is different from the first amount of light, and corresponding to the light reflected from the detection pattern;

acquire a threshold which is more than the first estimated voltage and is less than the second estimated voltage based on the first estimated voltage and the second estimated voltage; and perform misregistration correction or density correction, based on a detection result which is detected by the detection unit such that the light-emitting device emits light onto the detection pattern and the threshold.

13. The image forming apparatus according to claim 12, wherein the detection pattern includes a first pattern and a second pattern, the first pattern including toner images of a plurality of colors including black and non-black colors and the second pattern including toner images including different tones for each of the plurality of colors.

14. The image forming apparatus according to claim 13, wherein the first pattern includes a toner image formed by superimposing a black toner image upon a toner image of at least one of the non-black colors.

15. The image forming apparatus according to claim 13, wherein the first pattern is a pattern for detecting the amount of misregistration, and wherein the light-receiving device receives irregular reflection light from the first pattern and outputs a digital voltage value.

16. The image forming apparatus according to claim 13, wherein the second pattern is a pattern for detecting the amount of variation in density, and wherein the light-receiving device receives regular reflection light from the second pattern and outputs an analog voltage value.

17. The image forming apparatus according to claim 12, wherein the light-emitting device is a laser diode and the light-receiving device is a phototransistor.

* * * * *